US010980346B2

(12) United States Patent
Chen et al.

(10) Patent No.: US 10,980,346 B2
(45) Date of Patent: Apr. 20, 2021

(54) SYNCHRONIZATION SYSTEM, SLIDE RAIL ASSEMBLY AND DRIVING METHOD FOR SLIDE RAIL ASSEMBLY

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 14 days.

(21) Appl. No.: 16/511,040

(22) Filed: Jul. 15, 2019

(65) Prior Publication Data

US 2020/0375358 A1 Dec. 3, 2020

(30) Foreign Application Priority Data

May 27, 2019 (TW) ..... 10811847.0

(51) Int. Cl.

| | |
|---|---|
| ***A47B 95/00*** | (2006.01) |
| ***A47B 88/00*** | (2017.01) |
| ***A47B 88/45*** | (2017.01) |
| ***A47B 88/463*** | (2017.01) |
| *A47B 88/49* | (2017.01) |

(52) U.S. Cl.

CPC ..... *A47B 88/45* (2017.01); *A47B 88/463* (2017.01); *A47B 88/49* (2017.01)

(58) Field of Classification Search

CPC ..... A47B 88/47; A47B 88/463; A47B 88/45

See application file for complete search history.

(56) References Cited

U.S. PATENT DOCUMENTS

| | | | | |
|---|---|---|---|---|
| 8,152,250 | B2 * | 4/2012 | Aguilar Ante | A47B 88/493 312/331 |
| 8,534,781 | B2 * | 9/2013 | Netzer | A47B 88/463 312/331 |
| 8,833,879 | B2 * | 9/2014 | Netzer | A47B 88/423 312/333 |

(Continued)

FOREIGN PATENT DOCUMENTS

CN 108391990 A 8/2018

*Primary Examiner* — Kimberly S Wright

(74) *Attorney, Agent, or Firm* — Alan D. Kamrath; Karin L. Williams; Mayer & Williams PC

(57) ABSTRACT

A slide rail assembly includes a first rail, a second rail movable relative to the first rail, an elastic member, a locking member configured to temporarily lock the elastic member, and a synchronization device. The synchronization device includes a base connected to the second rail, a driving member movably mounted to a first part of the base, a mounting base arranged on a second part of the base, a sleeve, and a synchronization rod. The mounting base is configured to mount the sleeve connected with the synchronization rod. When the second rail is moved relative to the first rail from a retracted position to an over-pressing position along a first direction, the locking member unlocks the elastic member to release an elastic force for driving the second rail to move along a second direction, such that the driving member further drives the sleeve and the synchronization rod.

16 Claims, 14 Drawing Sheets

(56) References Cited

U.S. PATENT DOCUMENTS

| | | | | |
|---|---|---|---|---|
| 8,911,038 | B2 * | 12/2014 | Gmeiner | A47B 88/467 312/331 |
| 8,950,833 | B2 * | 2/2015 | Bohle | A47B 88/45 312/331 |
| 9,565,937 | B1 * | 2/2017 | Jansen | A47B 88/45 |
| 10,172,459 | B2 * | 1/2019 | Chen | A47B 88/437 |
| 10,405,653 | B2 * | 9/2019 | Goetz | A47B 88/447 |
| 2008/0036345 | A1 * | 2/2008 | Kropf | A47B 88/463 312/333 |
| 2010/0219727 | A1 * | 9/2010 | Aguilar Ante | A47B 88/40 312/319.1 |
| 2012/0038255 | A1 * | 2/2012 | Netzer | A47B 88/463 312/319.1 |
| 2013/0249368 | A1 * | 9/2013 | Netzer | A47B 88/423 312/334.8 |
| 2017/0049235 | A1 | 2/2017 | Albrecht et al. | |
| 2017/0095084 | A1 * | 4/2017 | Koenig | A47B 88/467 |
| 2018/0020833 | A1 * | 1/2018 | Goetz | A47B 88/463 312/331 |
| 2018/0160808 | A1 | 6/2018 | Wohlgenannt | |
| 2018/0263369 | A1 * | 9/2018 | Chen | A47B 88/45 |

* cited by examiner

SYNCHRONIZATION SYSTEM, SLIDE RAIL ASSEMBLY AND DRIVING METHOD FOR SLIDE RAIL ASSEMBLY

BACKGROUND OF THE INVENTION

1. Field of the Invention

The present invention relates to a slide rail assembly, and more particularly, to a synchronization system, a slide rail assembly and a driving method for a slide rail assembly.

2. Description of the Prior Art

Generally, in a furniture system, a drawer can be opened or retracted relative to a cabinet through a pair of slide rail assemblies. A product capable of assisting in opening a drawer from a retracted position relative to a cabinet is already provided in current market, and the product is so called a push-open product. Specifically, when a movable rail of a slide rail assembly is located at a retracted position relative to a fixed rail, a user can press the drawer carried by the movable rail to drive the movable rail to move relative to the fixed rail fixed to the cabinet from the retracted position to an over-pressing position along a closing direction; and when the movable rail is moved to the over-pressing position, an opening mechanism of the slide rail assembly is configured to unlock an elastic member, such that the elastic member releases an elastic force to drive the movable rail and the drawer to open along an opening direction.

Moreover, U.S. Pat. No. 10,172,459 B2 discloses a synchronization system for a slide rail assembly. The synchronization system is applicable to a slide rail assembly with the aforementioned press-open technology. Furthermore, the synchronization system is arranged on a first slide rail assembly and a second slide rail assembly. The synchronization system comprises a first synchronization device, a second synchronization device and a synchronization rod. The first synchronization device is arranged on the first slide rail assembly. The second synchronization device is arranged on the second slide rail assembly. The synchronization rod is movably mounted between the first synchronization device and the second synchronization device. When a movable rail of the first slide rail assembly of the aforementioned patent is pressed by a user to move relative to a fixed rail of the first slide rail assembly from a retracted position (as shown in FIG. 11 of the aforementioned patent) to an over-pressing position (as shown in FIG. 13 and FIG. 14 of the aforementioned patent) along a closing direction, a locking member of a first opening mechanism of the first slide rail assembly is driven to move to further unlock an elastic member of the first opening mechanism, such that the elastic member of the first opening mechanism of the first slide rail assembly releases an elastic force to drive the movable rail of the first slide rail assembly to move along an opening direction. In such slide rail technology, if the user continuously presses the movable rail of the first slide rail assembly, the movable rail of the first slide rail assembly will not be driven to move along the opening direction by the elastic force of the elastic member of the first opening mechanism. However, the synchronization rod will drive a driving member of the second synchronization device of the second slide rail assembly to move, such that a locking member of a second opening mechanism of the second slide rail assembly is driven to move to further unlock an elastic member of the second opening mechanism. As such, the elastic member of the second slide rail assembly will release an elastic force to drive the movable rail of the second slide rail assembly to open along the opening direction in advance relative to the movable rail of the first slide rail assembly which is pressed by the user. In addition, in such driving method of the slide rail assembly, when the movable rail of the first slide rail assembly is pressed and when the elastic member of the second slide rail assembly is driven to release the elastic force for driving the movable rail of the second slide rail assembly to move, an unexpected noise will be generated. Therefore, for different market requirements, it is important to develop a different slide rail synchronization product.

SUMMARY OF THE INVENTION

The present invention relates to a synchronization system, a slide rail assembly and a method for driving a slide rail assembly.

According to an embodiment of the present invention, a synchronization system applicable to a furniture system comprises a first slide rail assembly, a second slide rail assembly, a first synchronization device, a second synchronization device and a synchronization rod. Each of the first slide rail assembly and the second slide rail assembly comprises a first rail and a second rail longitudinally movable relative to the first rail. The first slide rail assembly and the second slide rail assembly further comprise a first opening mechanism and a second opening mechanism respectively. Each of the first opening mechanisms and the second opening mechanisms comprises an elastic member and a locking member configured to lock the elastic member. The first synchronization device is arranged on the second rail of the first slide rail assembly. The first synchronization device comprises a driving member. The second synchronization device is arranged on the second rail of the second slide rail assembly. The second synchronization device comprises a working member. The synchronization rod is movably arranged between the first synchronization device and the second synchronization device. Wherein, when the second rail of the first slide rail assembly is moved relative to the first rail of the first slide rail assembly from a retracted position to an over-pressing position along a first direction, the locking member of the first opening mechanism is configured to unlock the elastic member to allow the elastic member of the first opening mechanism to release a first elastic force for driving the second rail of the first slide rail assembly to move relative to the first rail of the first slide rail assembly from the over-pressing position along a second direction. Wherein, when the second rail of the first slide rail assembly is moved a predetermined distance from the over-pressing position along the second direction, the driving member of the first synchronization device is driven to move to further drive the synchronization rod to rotate to further move the working member of the second synchronization device, such that the locking member of the second opening mechanism is configured to unlock the elastic member of the second opening mechanism to allow the elastic member of the second opening mechanism to release a second elastic force for driving the second rail of the second slide rail assembly to move along the second direction. Wherein, the second direction is opposite to the first direction.

Preferably, the first synchronization device and the second synchronization device are respectively detachably mounted to the second rails of the first slide rail assembly and the second rail of the second slide rail assembly.

Preferably, the synchronization rod is detachably mounted between the first synchronization device and the second synchronization device.

Preferably, the first slide rail assembly further comprises a carrying member and a connecting base. The carrying member is fixedly attached to the second rail of the first slide rail assembly. The connecting base is fixed to the carrying member. The connecting base comprises a disengaging part and an engaging part. The disengaging part is longitudinally arranged, and the engaging part is bent relative to the disengaging part. The locking member of the first opening mechanism is configured to lock the elastic member of the first opening mechanism through the engaging part of the connecting base, and the locking member of the first opening mechanism is configured to unlock the elastic member of the first opening mechanism through the disengaging part of the connecting base.

Preferably, the connecting base is formed with a space. The first slide rail assembly further comprises a slide rail part accommodated in the space of the connecting base. The slide rail part and the connecting base are configured to be longitudinally movable relative to each other. The slide rail part is arranged with an auxiliary member, and the auxiliary member comprises a first contact part. The first synchronization device further comprises a base, an actuating member and a first elastic member. The base is mounted to the second rail of the first slide rail assembly. The driving member is movably mounted to the base. The actuating member is movable relative to the driving member. The actuating member comprises a second contact part. The first elastic member is configured to elastically press the actuating member. During a process of the second rail of the first slide rail assembly being moved from the retracted position to the over-pressing position along the first direction, the second contact part of the actuating member is configured to contact the first contact part of the auxiliary member to generate a working force, such that the actuating member is transversely moved relative to the driving member from a first predetermined position to a second predetermined position in response to the working force to allow the first elastic member to accumulate an elastic force. When the second rail of the first slide rail assembly is moved to the over-pressing position, the second contact part of the actuating member is configured to cross the first contact part of the auxiliary member, and the actuating member is configured to return to the first predetermined position in response to the elastic force released by the first elastic member. When the second rail of the first slide rail assembly is moved the predetermined distance from the over-pressing position along the second direction, the actuating member at the first predetermined position is configured to contact the auxiliary member to drive the driving member of the first synchronization device to move from an initial state to further drive the synchronization rod to rotate.

Preferably, one of the first contact part of the auxiliary member and the second contact part of the actuating member has an inclined surface or an arc surface.

Preferably, the driving member of the first synchronization device is pivoted relative to the base, and the first synchronization device further comprises a second elastic member. The driving member of the first synchronization device is configured to return to the initial state in response to an elastic force of the second elastic member.

Preferably, the first synchronization device further comprises a housing. The housing is configured to cover a portion of the driving member. The housing has a blocking feature configured to prevent the driving member from rotating along a predetermined direction.

Preferably, the base comprises a first part and a second part bent relative to the first part. The driving member of the first synchronization device is pivoted to the first part of the base, and the driving member has an accommodating room configured to accommodate at least one portion of the actuating member. The first synchronization device further comprises a mounting base and a sleeve. The mounting base is arranged on the second part of the base, and an end part of the synchronization rod is rotatably mounted to the mounting base through the sleeve.

Preferably, the second part of the base is substantially perpendicularly bent relative to the first part of the base.

Preferably, structural configuration of the second synchronization device is substantially identical to or symmetric to structural configuration of the first synchronization device, and structural configuration of the second slide rail assembly is substantially identical to or symmetric to structural configuration of the first slide rail assembly.

Preferably, the first rail is fixedly mounted to a first furniture part of the furniture system, and the second rail is configured to carry a second furniture part of the furniture system.

According to another embodiment of the present invention, a slide rail assembly comprises a first rail, a second rail, an opening mechanism and a synchronization device. The second rail is longitudinally movable relative to the first rail. The opening mechanism comprises an elastic member and a locking member configured to temporarily lock the elastic member. The synchronization device comprises a base, a driving member, a mounting base, a sleeve and a synchronization rod. The base is connected to the second rail of the slide rail assembly. The base comprises a first part and a second part. The driving member is movably mounted to the first part of the base. The mounting base is arranged on the second part of the base. The sleeve is rotatably mounted to the mounting base. The synchronization rod is connected to the sleeve. Wherein, when the second rail is moved relative to the first rail from a retracted position to an over-pressing position along a first direction, the locking member is configured to unlock the elastic member to allow the elastic member to release an elastic force for driving the second rail to move along a second direction. Wherein, when the second rail is moved a predetermined distance along the second direction, the driving member is driven to move to further drive the sleeve to rotate for driving the synchronization rod to rotate accordingly.

According to another embodiment of the present invention, a driving method for a slide rail assembly comprises providing a first slide rail assembly and a second slide rail assembly, wherein each of the first slide rail assembly and the second slide rail assembly comprises a first rail and a second rail movable relative to the first rail; providing a first opening mechanism and a second opening mechanism respectively arranged on the first slide rail assembly and the second slide rail assembly, wherein each of the first opening mechanism and the second opening mechanism comprises an elastic member and a locking member configured to temporarily lock the elastic member; providing a first synchronization device arranged on the second rail of the first slide rail assembly, wherein the first synchronization device comprises a driving member; providing a second synchronization device arranged on the second rail of the second slide rail assembly, wherein the second synchronization device comprises a working member; providing a synchronization rod movably arranged between the first synchronization device and the second synchronization device; applying a force to the second rail of the first slide rail assembly to move the second rail of the first slide rail assembly from a retracted position to an over-pressing position along a first direction; the locking member of the first opening mechanism unlocking the elastic member of the first opening mechanism in response to the second rail of the first slide rail assembly being located at the over-pressing position, to allow the elastic member of the first opening mechanism to release a first elastic force for driving the second rail of the first slide rail assembly to move along a second direction opposite to the first direction; and the driving member of the first synchronization device driving the synchronization rod to rotate to further move the working member of the second synchronization device when the second rail of the first slide rail assembly is moved a predetermined distance along the second direction, so as to drive the locking member of the second opening mechanism to unlock the elastic member of the second opening mechanism to allow the elastic member of the second opening mechanism to release a second elastic force for driving the second rail of the second slide rail assembly to move along the second direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
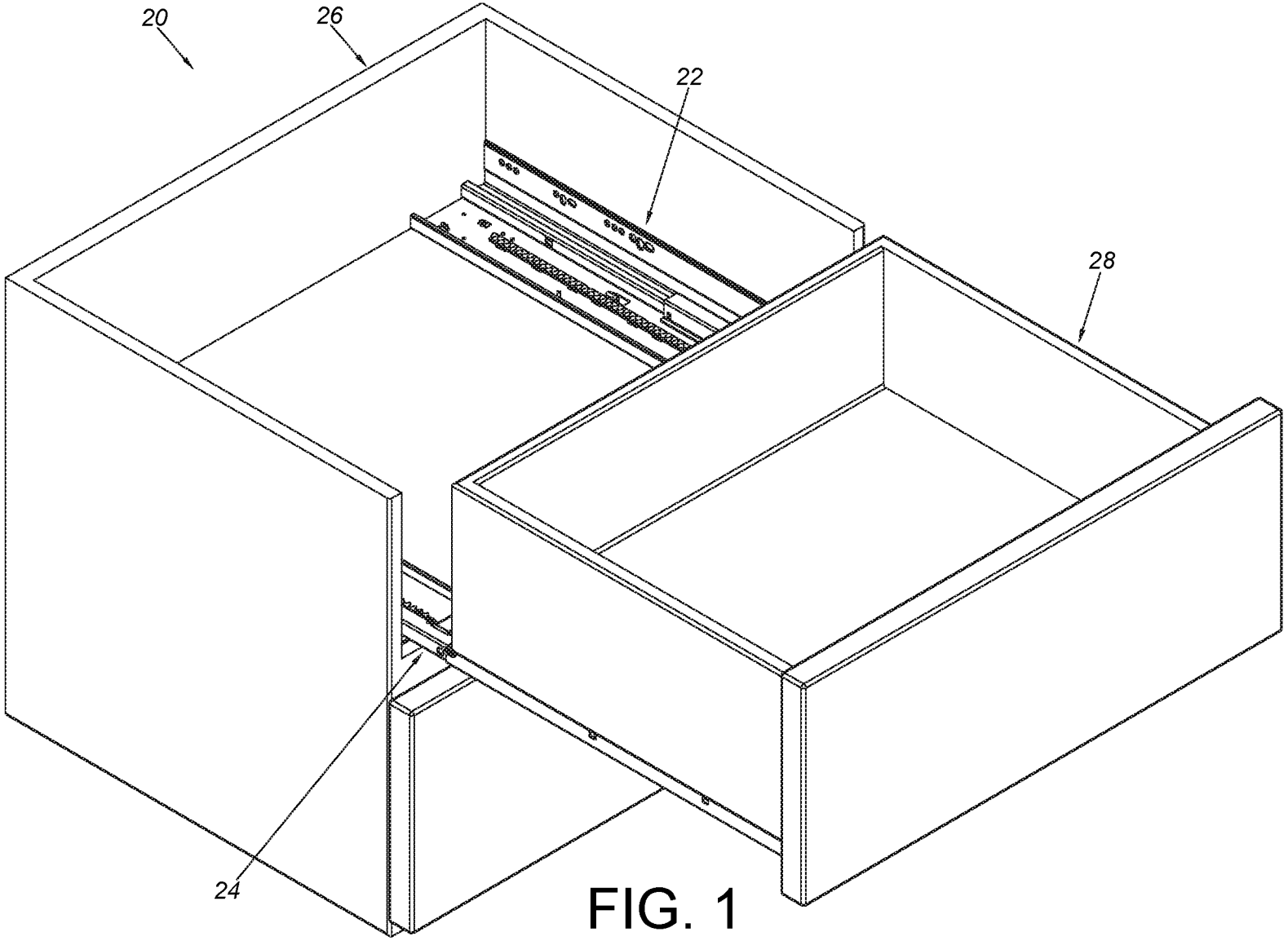
FIG. 1 is a diagram showing a furniture system according to an embodiment of the present invention.

As shown in FIG. 1, a furniture system 20 comprises a first slide rail assembly 22 and a second slide rail assembly 24. Furthermore, the furniture system 20 comprises a first furniture part 26 and a second furniture part 28. The first furniture part 26 can be a cabinet, and the second furniture part 28 can be a drawer, but the present invention is not limited thereto. The first slide rail assembly 22 and the second slide rail assembly 24 are configured to mount the second furniture part 28, such that the second furniture part 28 can be easily moved relative to the first furniture part 26 through the first slide rail assembly 22 and the second slide rail assembly 24.

Figure 2:
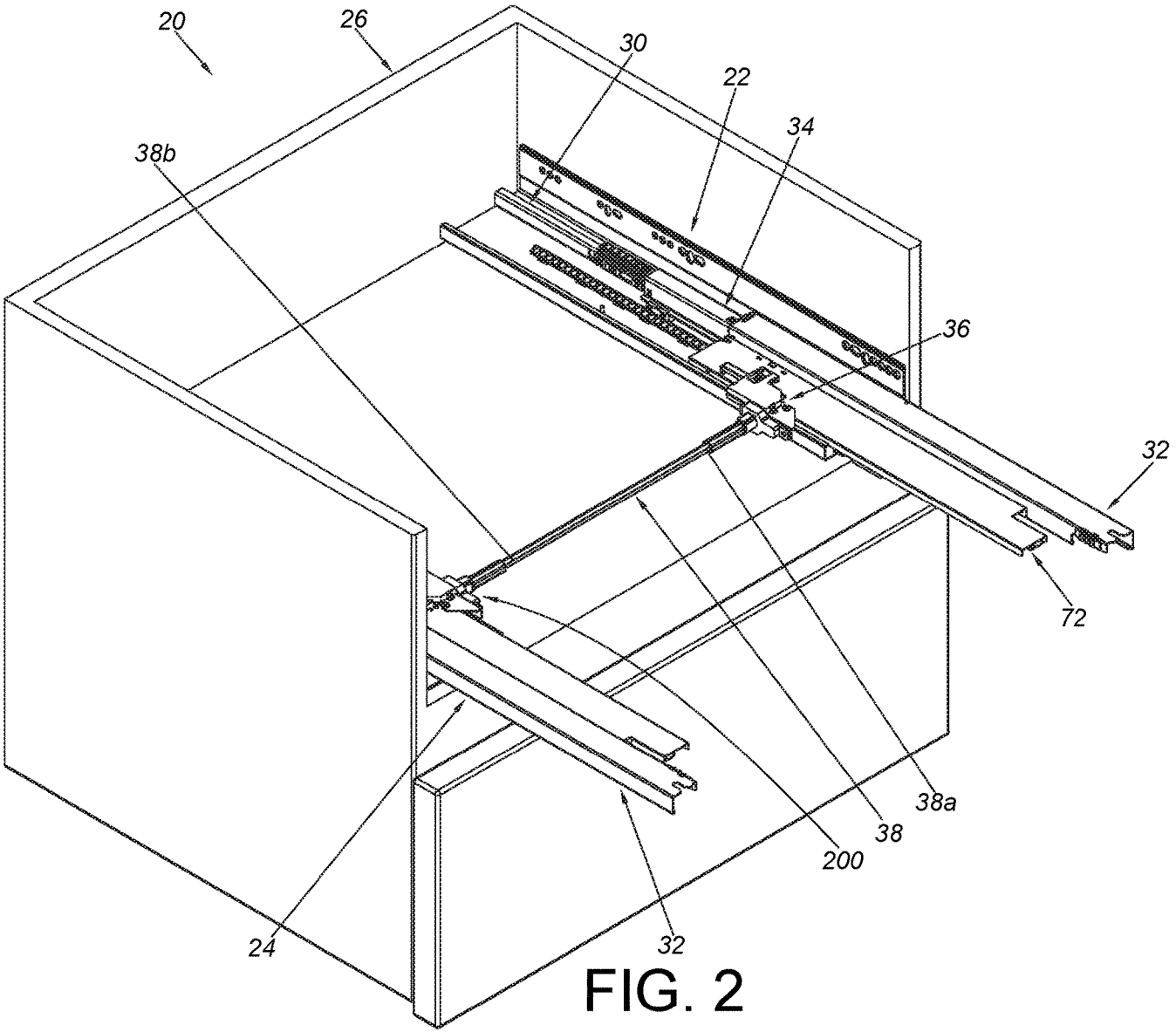
FIG. 2 is a diagram showing a synchronization system applicable to a first slide rail assembly and a second slide rail assembly of the furniture system according to an embodiment of the present invention.

As shown in FIG. 2, structural configuration of the second slide rail assembly 24 is substantially identical to or symmetric to structural configuration of the first slide rail assembly 22, and the first slide rail assembly 22 and the second slide rail assembly 24 are respectively located at two sides of the first furniture part 26. Specifically, each of the first slide rail assembly 22 and the second slide rail assembly 24 comprises a first rail 30 (such as a fixed rail) and a second rail 32 (such as a movable rail) longitudinally movable relative to the first rail 30. Preferably, each of the first slide rail assembly 22 and the second slide rail assembly 24 further comprises a third rail 34 (such as a middle rail) movably mounted between the first rail 30 and the second rail 32. The third rail 34 is configured to extend a traveling distance of the second rail 32 relative to the first rail 30. The first rail 30 is fixedly mounted to the first furniture part 26, and the second rail 32 is configured to carry the second furniture part 28 (please refer to FIG. 1). According to an embodiment of the present invention, a synchronization system comprising a first synchronization device 36 and a second synchronization device 200 is applicable to the furniture system 20.

The first synchronization device 36 is arranged on the first slide rail assembly 22, such as being arranged on the second rail 32 of the first slide rail assembly 22. On the other hand, the second synchronization device 200 is arranged on the second slide rail assembly 24, such as being arranged on the second rail 32 of the second slide rail assembly 24. Moreover, the synchronization system further comprises a synchronization rod 38 movably arranged between the first synchronization device 36 and the second synchronization device 200. Preferably, a first end part 38*a* and a second end part 38*b* of the synchronization rod 38 are detachably mounted to the first synchronization device 36 and the second synchronization device 200 respectively.

Figure 3:
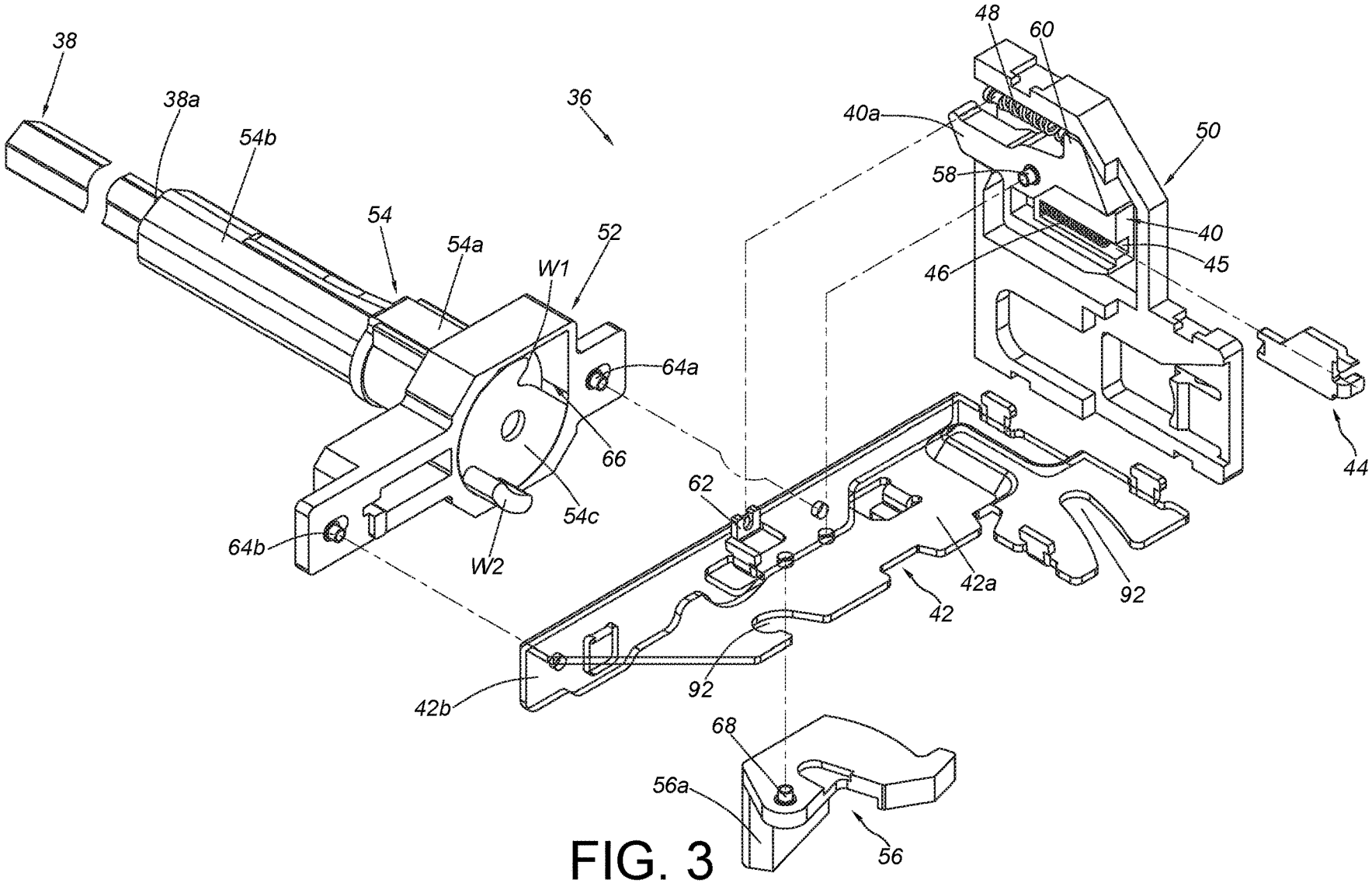
FIG. 3 is an exploded view of a synchronization device according to an embodiment of the present invention.
Figure 4:
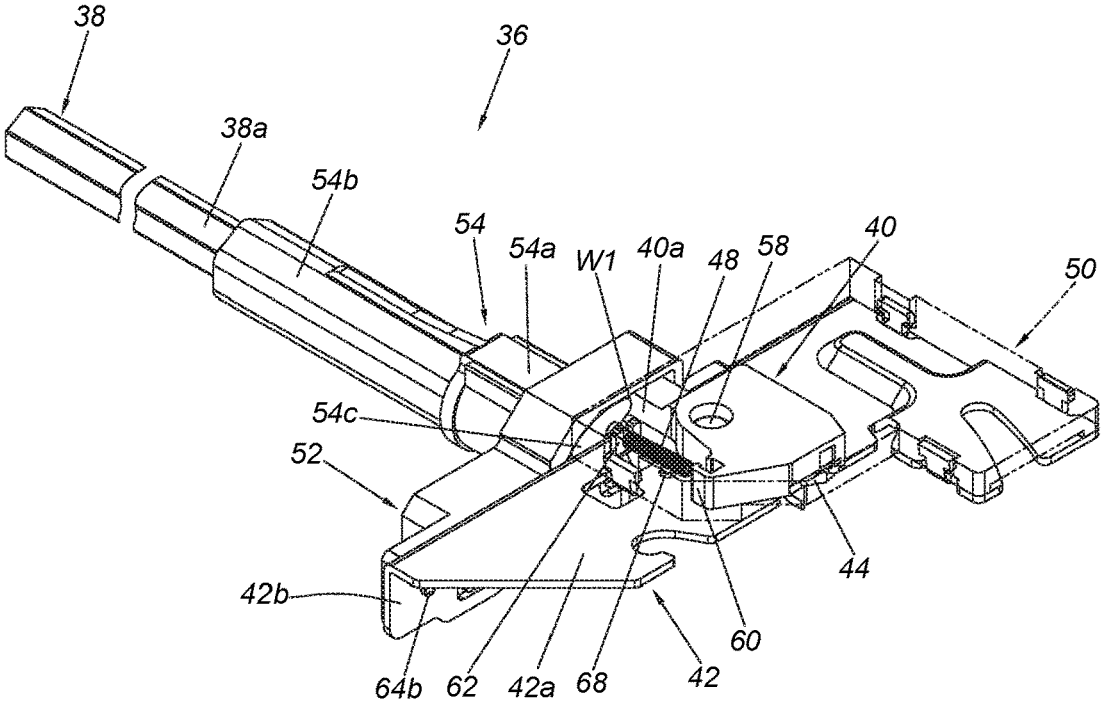
FIG. 4 is a diagram showing the synchronization device according to an embodiment of the present invention.
Figure 5:
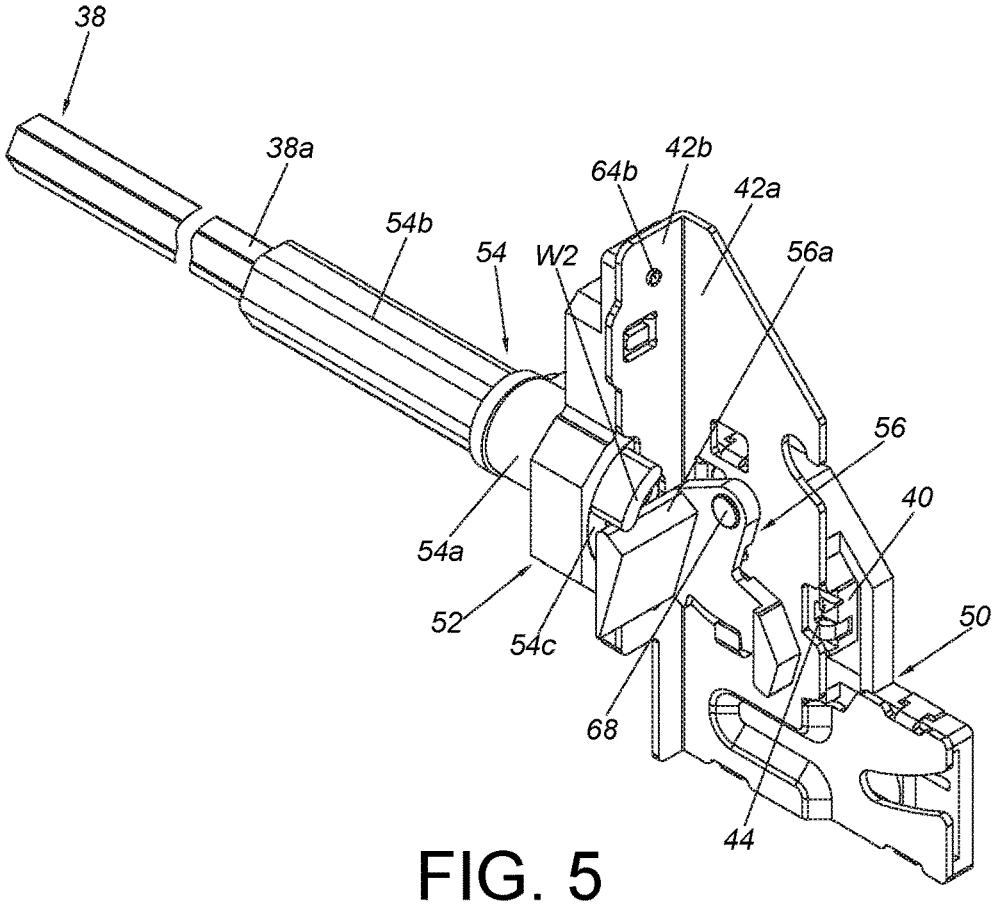
FIG. 5 is a diagram showing the synchronization device in another viewing angle according to an embodiment of the present invention.

As shown in FIG. 3, FIG. 4 and FIG. 5, structural configuration of the second synchronization device 200 is substantially identical to or symmetric to structural configuration of the first synchronization device 36. For simplification, only the first synchronization device 36 is illustrated. Furthermore, the first synchronization device 36 comprises a driving member 40. Preferably, the first synchronization device 36 further comprises a base 42, an actuating member 44, a first elastic member 46, a second elastic member 48, a housing 50, a mounting base 52, a sleeve 54 and a working member 56.

The base 42 comprises a first part 42*a* and a second part 42*b*. Preferably, the second part 42*b* is substantially perpendicularly bent relative to the first part 42*a*.

The driving member 40 is movably mounted to the base 42. In the present embodiment, the driving member 40 is pivoted relative to the base 42 through a first shaft member 58. For example, the driving member 40 is pivoted to one side (such as a top side, but the present invention is not limited thereto) of the first part 42*a* of the base 42 through the first shaft member 58. Preferably, the driving member 40 has an accommodating room 45 configured to accommodate at least one portion of the actuating member 44. Preferably, the accommodating room 45 is a groove which is transversely arranged along a longitudinal direction of each of the slide rail assemblies.

The actuating member 44 is movable relative to the driving member 40. For example, the actuating member 44 is linearly movable relative to the driving member 40 through the accommodating room 45 of the driving member 40.

The first elastic member 46 is configured to elastically press the actuating member 44. Preferably, the first elastic member 46 is arranged in the accommodating room 45 of the driving member 40 and configured to provide an elastic force to the actuating member 44.

The second elastic member 48 is configured to provide an elastic force to the driving member 40. Specifically, the driving member 40 is configured to stay in an initial state in response to the elastic force of the second elastic member 48. Preferably, the second elastic member 48 is a return spring, and two ends of the second elastic ember 48 are respectively connected to a first connecting part 60 of the driving member 40 and a second connecting part 62 of the base 42.

The housing 50 is configured to cover a portion of the driving member 40. In the present embodiment, the housing 50 almost covers the whole driving member 40, but the present invention is not limited thereto. Preferably, the housing 50 is configured to at least protect the driving member 40, the actuating member 44, the first elastic member 46 and the second elastic member 48, in order to prevent those related parts from being damaged by external factors (such as dust or moisture).

The mounting base 52 is arranged on the second part 42*b* of the base 42. In the present embodiment, the mounting base 52 is connected to the second part 42*b* of the base 42 through at least one connecting member (such as a first connecting member 64*a* and a second connecting member 64*b*). Preferably, the mounting base 52 is formed with a space 66.

The sleeve 54 is rotatably mounted to the mounting base 52. Preferably, the sleeve 54 comprises a base part 54*a* and an extension part 54*b*. A bottom portion 54*c* of the base part 54*a* is accommodated in the space 66 of the mounting base 52, and the extension part 54*b* is extended from the base part 54*a* to be away from the bottom portion 54*c*. The first end part 38*a* of the synchronization rod 38 is connected to the extension part 54*b*. Preferably, the bottom portion 54*c* of the base part 54*a* has a first section W1 and a second section W2 configured to respectively interact with a driving part 40*a* of the driving member 40 and a working wall 56*a* of the working member 56. Each of the first section W1 and the second section W2 can be a protrusion or a wall, but the present invention is not limited thereto.

The working member 56 is pivoted relative to the base 42 through a second shaft member 68. For example, the working member 56 is pivoted to the other side (such as a bottom side, but the present invention is not limited thereto) of the first part 42*a* of the base 42 through the second shaft member 68. As such, the driving member 40 and the working member 56 are located at different sides of the first part 42*a* of the base 42.

Figure 7:
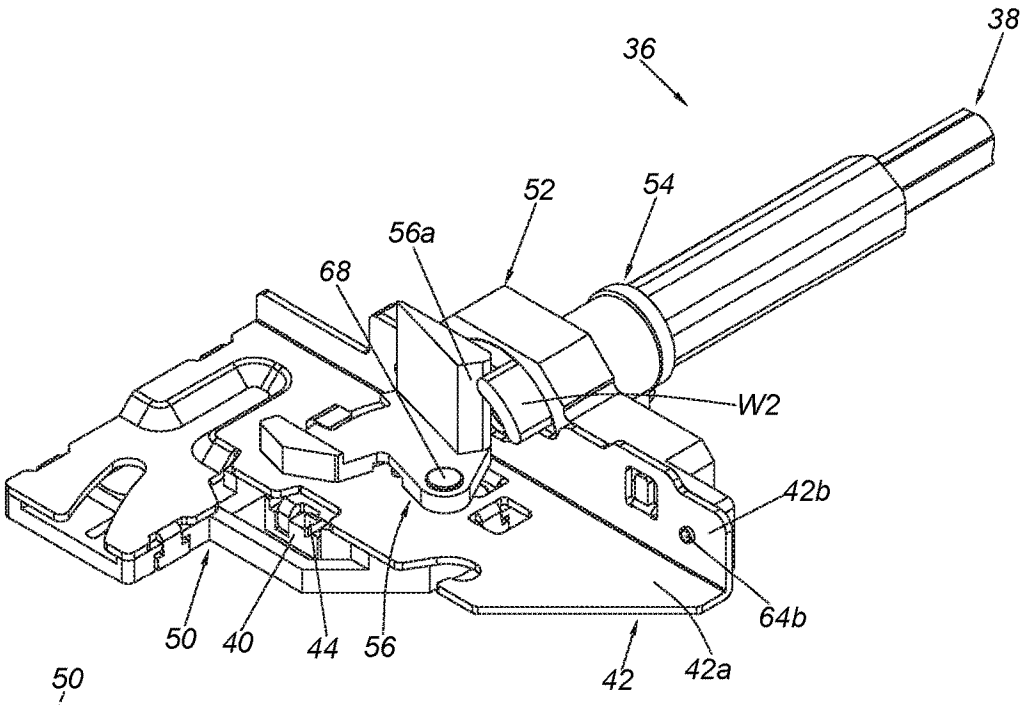
FIG. 7 is a diagram showing the related parts of the synchronization device being in the initial state in a second viewing angle according to an embodiment of the present invention.
Figure 6:
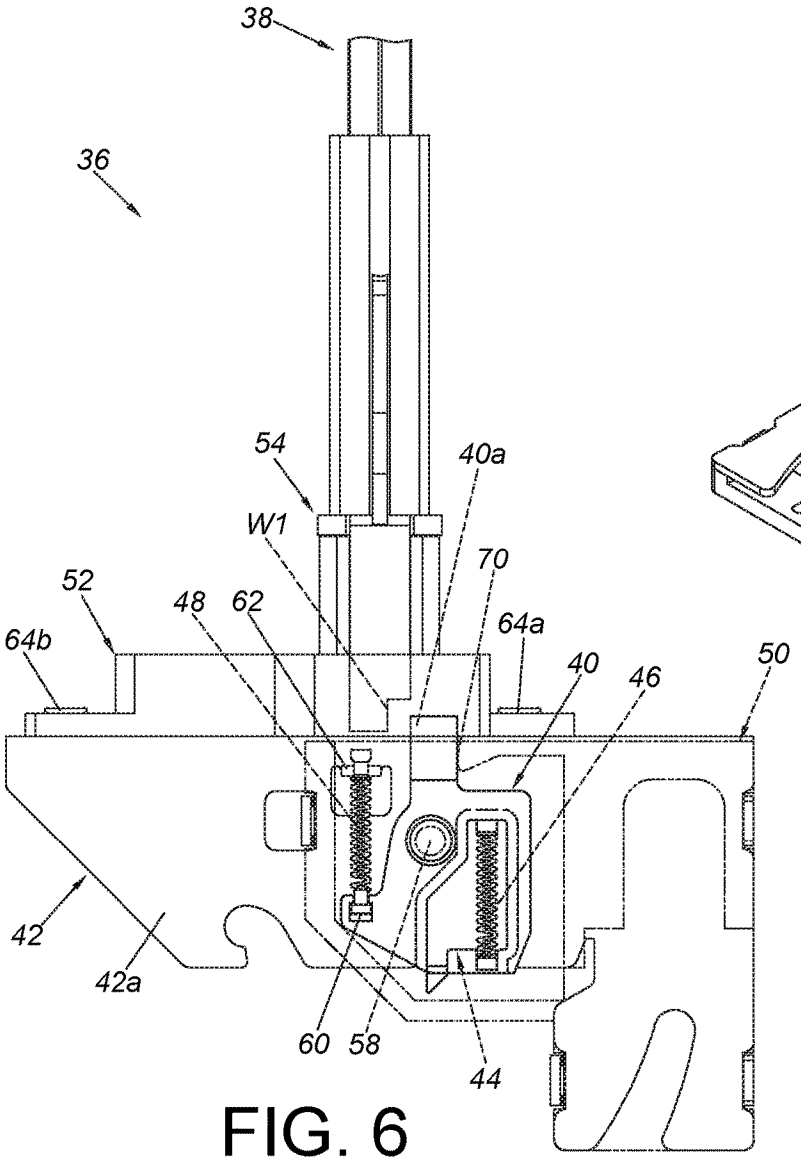
FIG. 6 is a diagram showing related parts of the synchronization device being in an initial state in a first viewing angle according to an embodiment of the present invention.

As shown in FIG. 6 and FIG. 7, the driving member 40, the actuating member 44, the first elastic member 46 and the second elastic member 48 of the first synchronization device 36 are located at one side (such as the top side shown in FIG. 6) of the first part 42*a* of the base 42, and the working member 56 of the first synchronization device 36 is located at the other side (such as the bottom side shown in FIG. 7) of the first part 42*a* of the base 42. Moreover, the driving member 40, the actuating member 44, the first elastic member 46, the second elastic member 48, the sleeve 54, the synchronization rod 38 and the working member 56 are respectively in an initial state while no force is applied.

Figure 9:
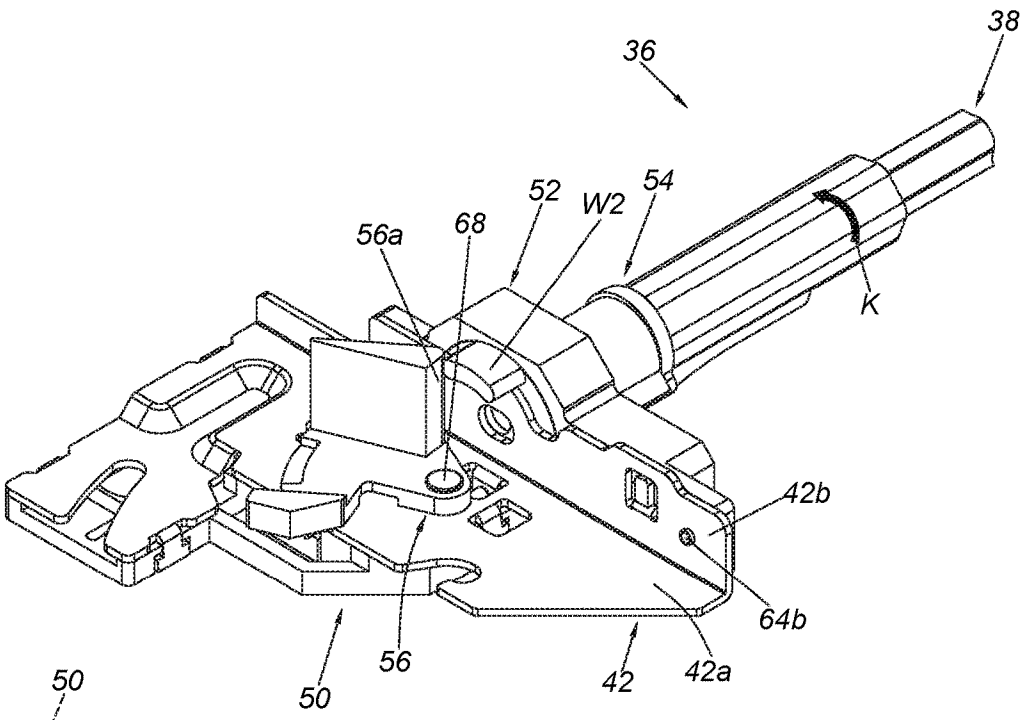
FIG. 9 is a diagram showing the synchronization device receiving the force to drive the related parts to be no longer in the initial state in the second viewing angle according to an embodiment of the present invention.
Figure 8:
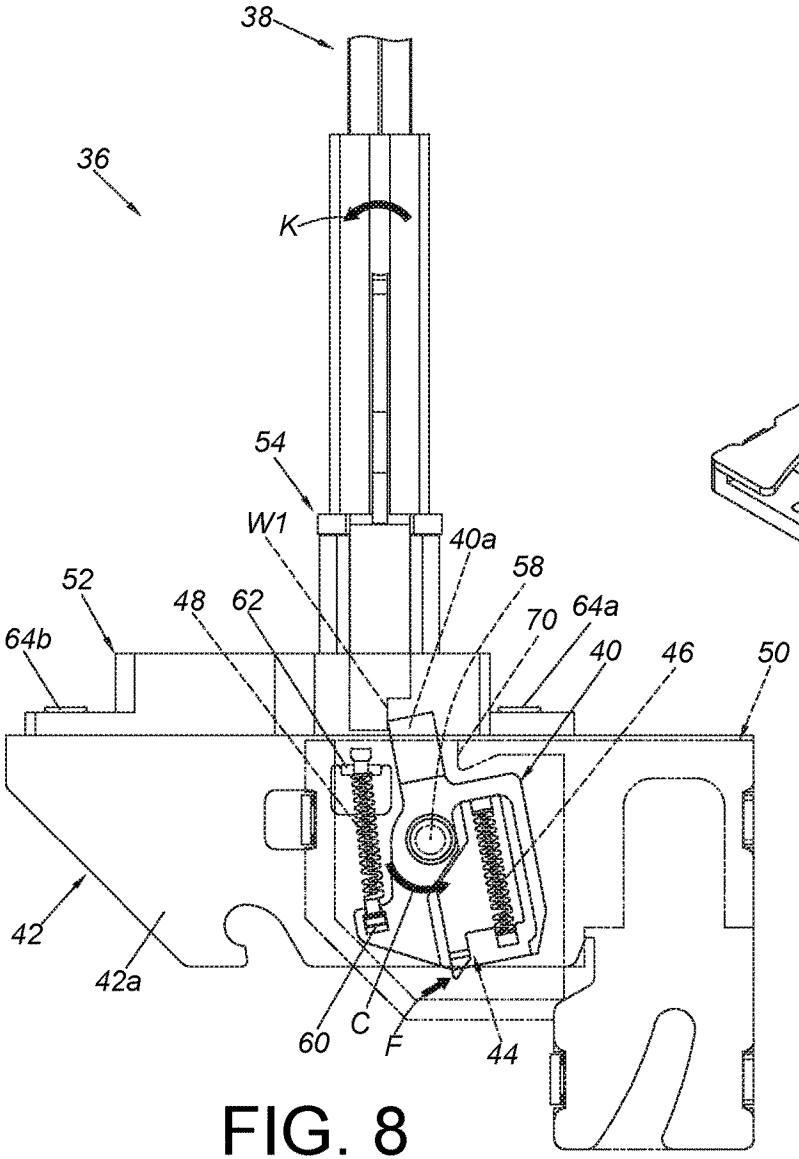
FIG. 8 is a diagram showing a force being applied to the synchronization device to drive the related parts to be no longer in the initial state in the first viewing angle according to an embodiment of the present invention.

As shown in FIG. 8 and FIG. 9, when a force F (such as an external force or a working force) is applied to the actuating member 44, the driving member 40 is driven to rotate along a rotary direction C in response to the force F (as shown in FIG. 8) being applied to the actuating member 44, and the driving part 40*a* of the driving member 40 is configured to push the first section W1 of the sleeve 54 in order to drive the sleeve 54 and the synchronization rod 38 to rotate along a predetermined rotation direction K. When the sleeve 54 is rotated along the predetermined rotation direction K, the second section W2 of the sleeve 54 is configured to abut against the working wall 56*a* of the working member 56, such that the working member 56 is driven to rotate accordingly (as shown in FIG. 9).

Moreover, when the driving member 40 is rotated along the rotary direction C in response to the force F (as shown in FIG. 8), the second elastic member 48 is configured to accumulate an elastic force. When the force F is no longer applied, the driving member 40 returns to the initial state in response to the elastic force of the second elastic member 48 (as shown in FIG. 6). In addition, as shown in FIG. 6, the housing 50 has a blocking feature 70, such as a wall, configured to prevent the driving member 40 from rotating along another rotary direction (i.e. a direction opposite to the rotary direction C).

Figures 10, 11:
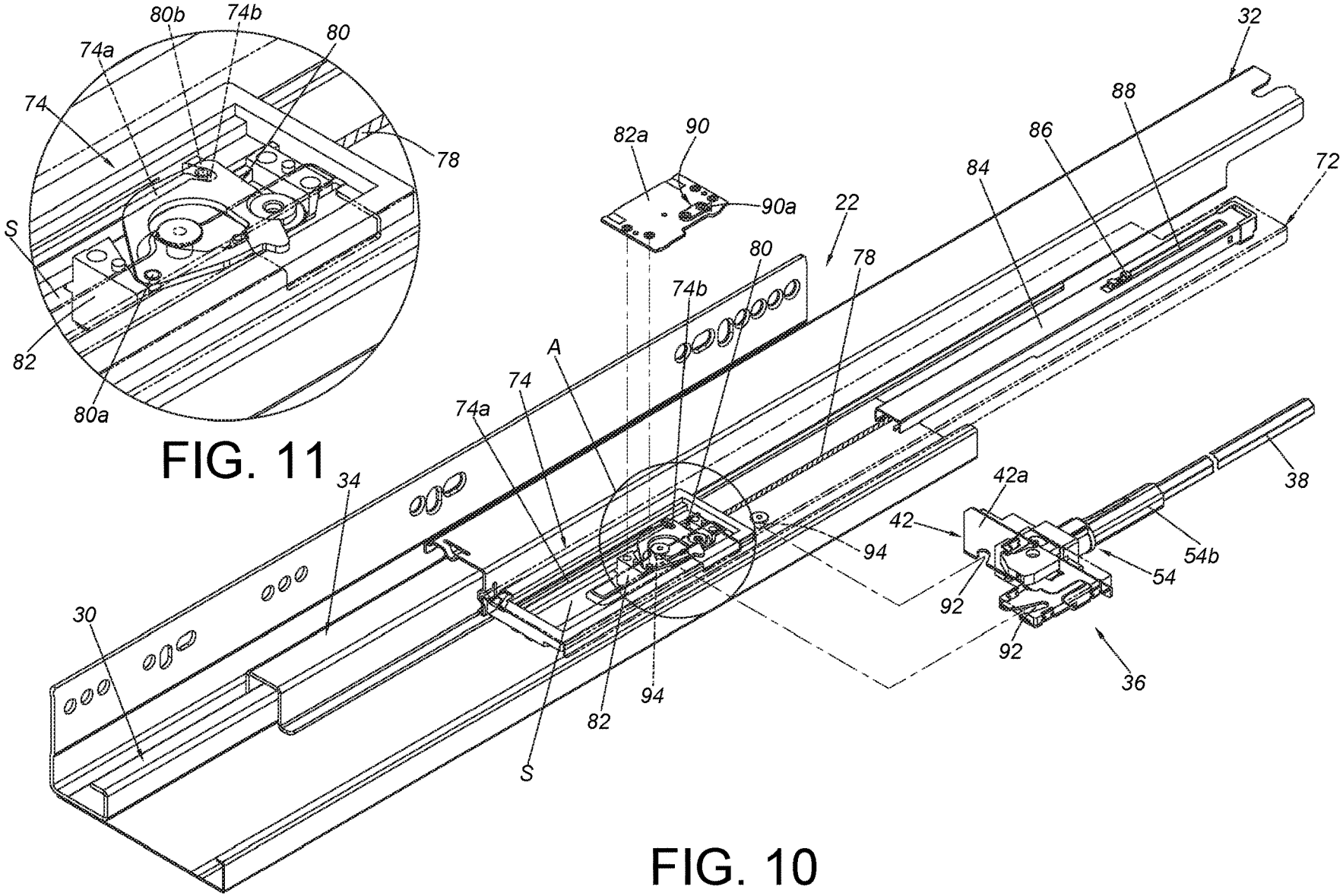
FIG. 10 is an exploded view showing the first slide rail assembly, the synchronization device and a cover member according to an embodiment of the present invention.
FIG. 11 is an enlarged view of an area A of FIG. 10.

As shown in FIG. 10, the second rail 32 and the third rail 34 of the first slide rail assembly 22 are respectively in an extended state relative to the first rail 30. Preferably, the first slide rail assembly 22 further comprises a carrying member 72 and a connecting base 74. The carrying member 72 is fixedly attached to and adjacent to the second rail 32 of the first slide rail assembly 22. On the other hand, the connecting base 74 is fixed to a bottom part of the carrying member 72. Therefore, each of the carrying member 72 and the connecting base 74 can be seen as a portion of the second rail 32 of the first slide rail assembly 22.

The connecting base 74 comprises a disengaging part 74*a* and an engaging part 74*b*. In the present embodiment, the disengaging part 74*a* and the engaging part 74*b* are guiding grooves communicated with each other. Furthermore, the disengaging part 74*a* is longitudinally arranged, and the engaging part 74*b* is bent relative to the disengaging part 74*a* (please also refer to FIG. 11).

Moreover, the first slide rail assembly 22 further comprises a first opening mechanism. The first opening mechanism comprises an elastic member 78 and a locking member 80 configured to temporarily lock the elastic member 78. The locking member 80 of the first opening mechanism is configured to lock the elastic member 78 of the first opening mechanism through the engaging part 74*b* of the connecting base 74, and the locking member 80 of the first opening mechanism is configured to unlock the elastic member 78 of the first opening mechanism through the disengaging part 74*a* of the connecting base 74.

Figures 12, 13:
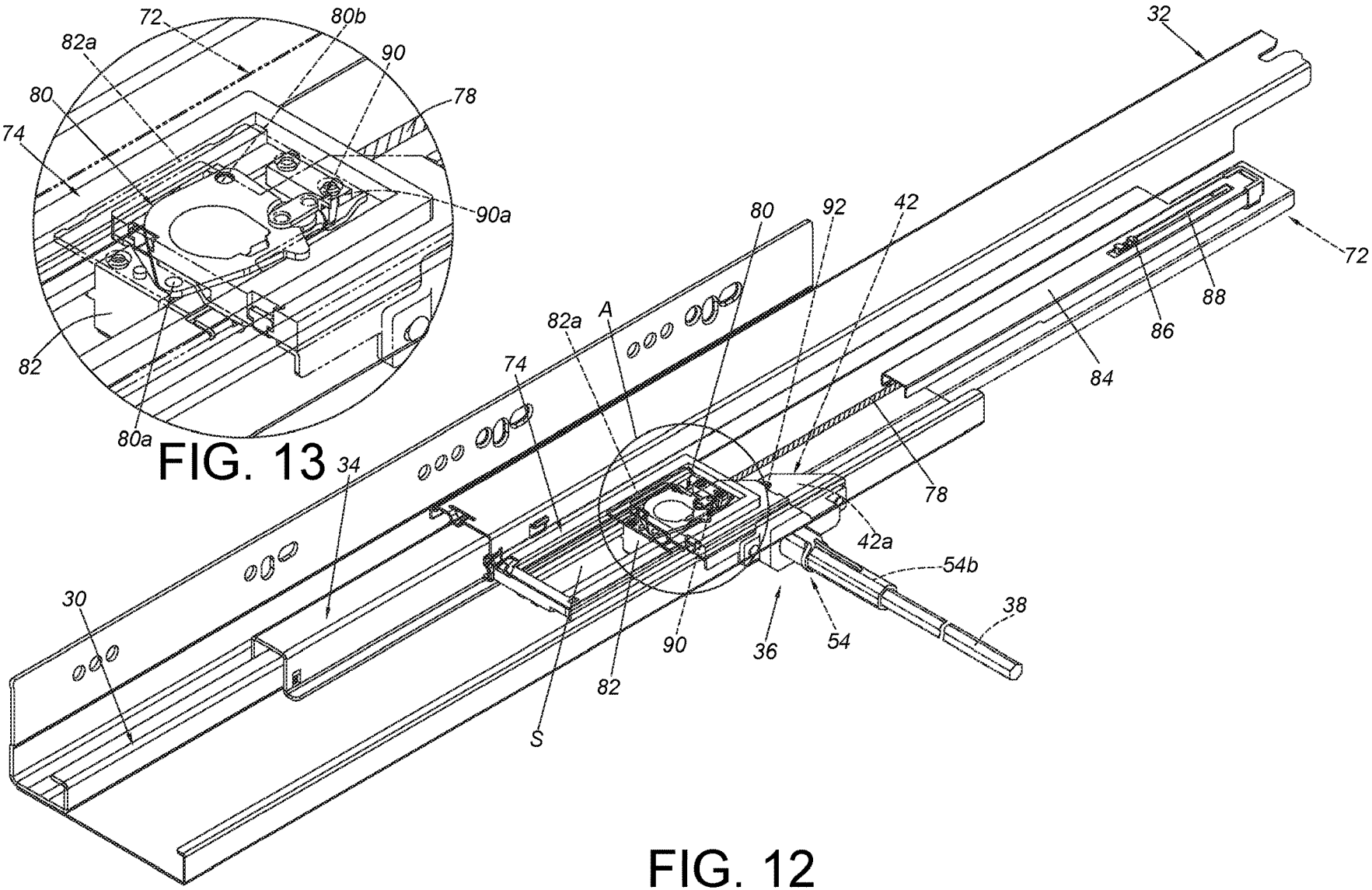
FIG. 12 is a diagram showing a combination of the first slide rail assembly, the synchronization device and the cover member according to an embodiment of the present invention.
FIG. 13 is an enlarged view of an area A of FIG. 12.

Preferably, the connecting base 74 is formed with a space S, and the first slide rail assembly 22 further comprises a slide rail part 82. The slide rail part 82 is accommodated in the space S of the connecting base 74. The slide rail part 82 and the connecting base 74 are longitudinally movable relative to each other through the space S. Preferably, the first slide rail assembly 22 further comprises a cover member 82*a* connected (such as fixedly connected) to the slide rail part 82 and can be seen as a portion of the slide rail part 82. The locking member 80 is movably arranged between the slide rail part 82 and the cover member 82*a* (please also refer to FIG. 13). The locking member 80 comprises a first leg 80*a* and a second leg 80*b*. The first leg 80*a* is pivoted to the slide rail part 82, and the second leg 80*b* is configured to be engaged with the engaging part 74*b* of the connecting base 74 (please also refer to FIG. 11). When the second leg 80*b* is engaged with the engaging part 74*b* of the connecting base 74, the locking member 80 is configured to lock the elastic member 78 to allow the elastic member 78 to accumulate an elastic force. When the second leg 80*b* is disengaged from the engaging part 74*b* of the connecting base 74 to enter the disengaging part 74*a* of the connecting base 74, the locking member 80 is configured to unlock the elastic member 78 to allow the elastic member 78 to release the elastic force. Preferably, the first slide rail assembly 22 further comprises a movable member 84. The movable member 84 and the carrying member 72 are longitudinally movable relative to each other, and the movable member 84 is arranged at the bottom part of the carrying member 72. Preferably, the movable member 84 and the carrying member 72 are movable relative to each other within a limited range through arrangement of a protrusion 86 and a bounded longitudinal elongated hole 88. The protrusion 86 penetrates a portion of the longitudinal elongated hole 88. Preferably, the elastic member 78 is arranged between the movable member 84 and the connecting base 74. In the present embodiment, the elastic member 78 is a spring, and two ends of the spring are respectively connected to the movable member 84 and the connecting base 74, but the present invention is not limited thereto.

In addition, the cover member 82*a* is arranged with an auxiliary member 90, and the auxiliary member 90 comprises a first contact part 90*a*. Preferably, the first part 42*a* of the base 42 of the first synchronization device 36 comprises at least one first engaging feature 92. The at least one first engaging feature 92 is configured to be engaged with at least one second engaging feature 94 of the carrying member 72 of the second rail 32 of the first slide rail assembly 22, such that the first synchronization device 36 can be detachably mounted to the carrying member 72 (please also refer to FIG. 10 and FIG. 12). In other words, the first synchronization device 36 can be detachably mounted to the second rail 32 of the first slide rail assembly 22. Similarly, the second synchronization device 200 can be detachably mounted to the second rail 32 of the second slide rail assembly 24.

Figure 14:
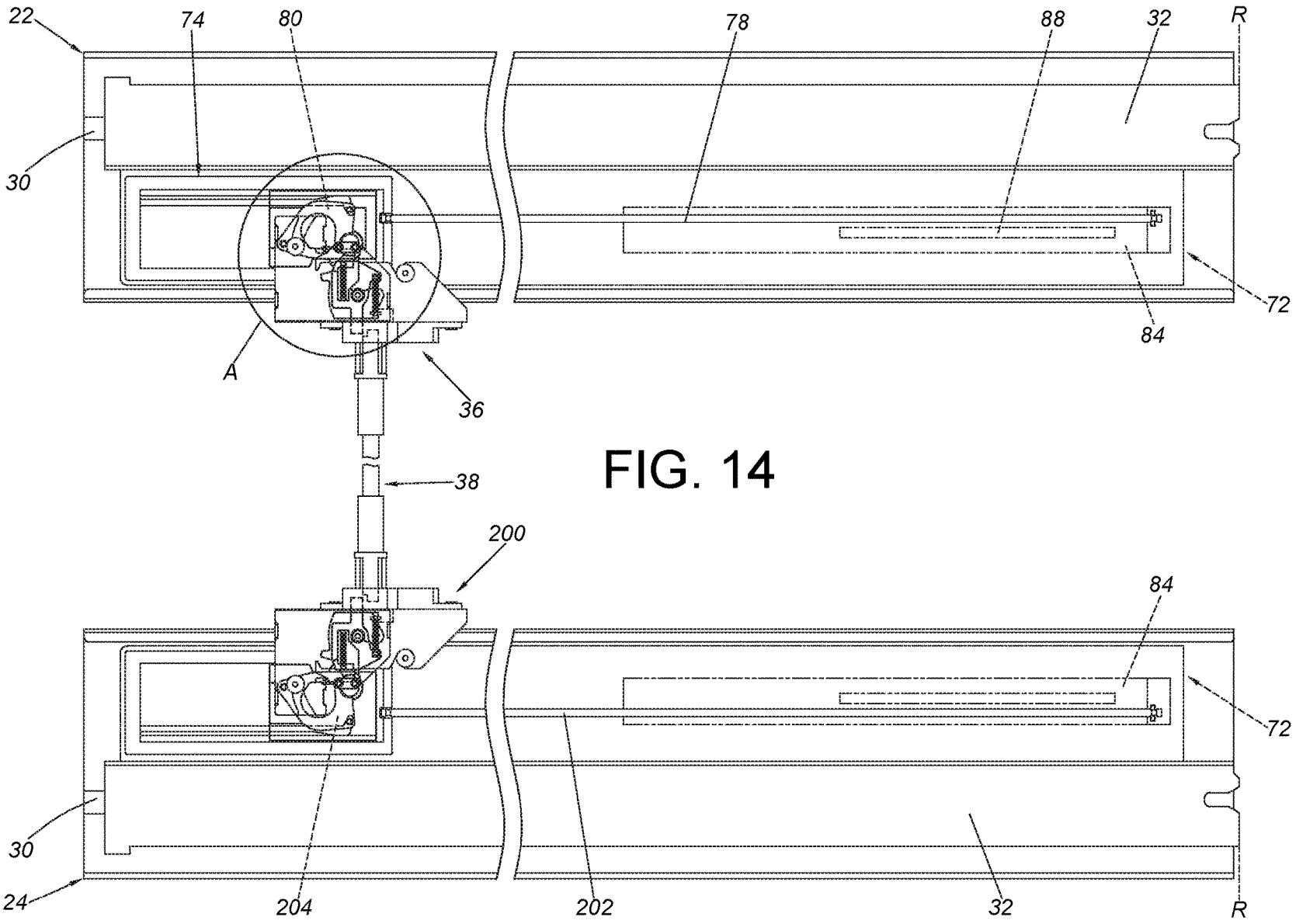
FIG. 14 is a diagram showing both second rails of the first slide rail assembly and the second slide rail assembly being located at a retracted position with the synchronization system being arranged on the second rail of the first slide rail assembly and the second rail of the second slide rail assembly according to an embodiment of the present invention.

As shown in FIG. 14, the structural configuration of the second slide rail assembly 24 is substantially identical to or symmetric to the structural configuration of the first slide rail assembly 22, and the structural configuration of the second synchronization device 200 is substantially identical to or symmetric to structural configuration of the first synchronization device 36. The synchronization rod 38 is movably arranged between the first synchronization device 36 and the second synchronization device 200. The first slide rail assembly 22 comprises a first opening mechanism, and the second slide rail assembly 24 comprises a second opening mechanism. Structural configuration of the second opening mechanism is substantially identical to or symmetric to structural configuration of the first opening mechanism. For example, the second opening mechanism comprises an elastic member 202 and a locking member 204 configured to temporarily lock the elastic member 202. Interaction between the elastic member 202 and the locking member 204 is identical to interaction between the elastic member 78 and the locking member 80 of the first opening mechanism. For simplification, no further illustration is provided.

Figure 15:
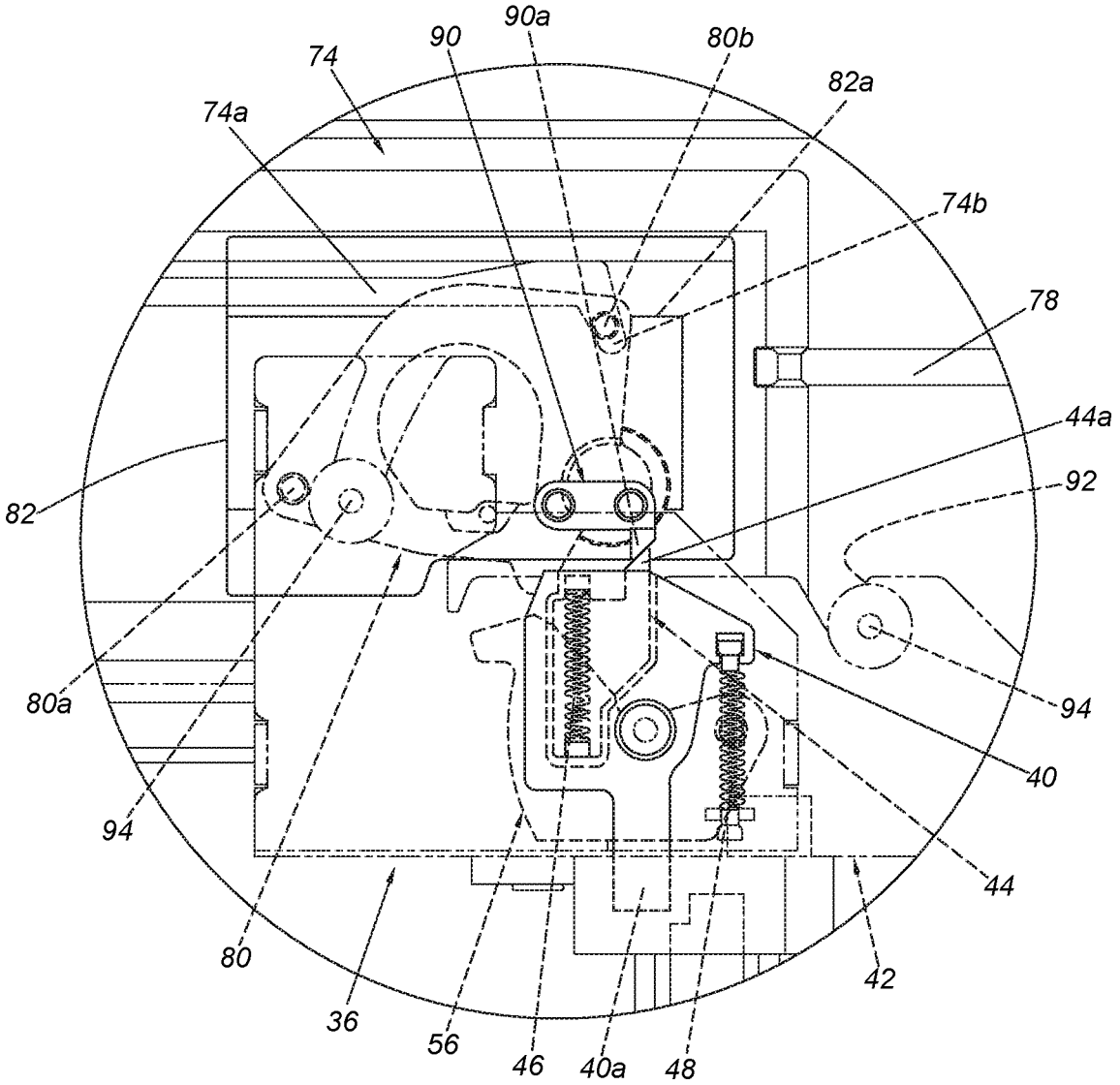
FIG. 15 an enlarged view of an area A of FIG. 14.

Furthermore, the second rails 32 of the first slide rail assembly 22 and the second slide rail assembly 24 are located at a retracted position R relative to the first rail 30. The related parts of the first synchronization device 36 and the second synchronization device 200 are in the initial state. Please also refer to FIG. 15 which shows the first synchronization device 36 in the initial state. Moreover, the first leg 80*a* of the locking member 80 of the first opening mechanism is pivoted to the slide rail part 82, and the second leg 80*b* of the locking member 80 is configured to be engaged with the engaging part 74*b* of the connecting base 74, such that the locking member 80 is configured to lock the elastic member 78 to allow the elastic member 78 to accumulate an elastic force. Similarly, the locking member 204 of the second slide rail assembly 24 is configured to lock the elastic member 202 (as shown in FIG. 14). In addition, as shown in FIG. 15, when the second rails 32 of the first slide rail assembly 22 and the second slide rail assembly 24 are located at the retracted positions R relative to the first rails 30, a second contact part 44*a* of the actuating member 44 of the first synchronization device 36 is located at a position corresponding one side of the first contact part 90*a* of the auxiliary member 90. The actuating member 44 is located at a first predetermined position. Preferably, at least one of the first contact part 90*a* of the auxiliary member 90 and the second contact part 44*a* of the actuating member 44 has an inclined surface or an arc surface. In the present embodiment, each of the first contact part 90*a* and the second contact part 44*a* has an inclined surface, but the present invention is not limited thereto.

Figure 16:
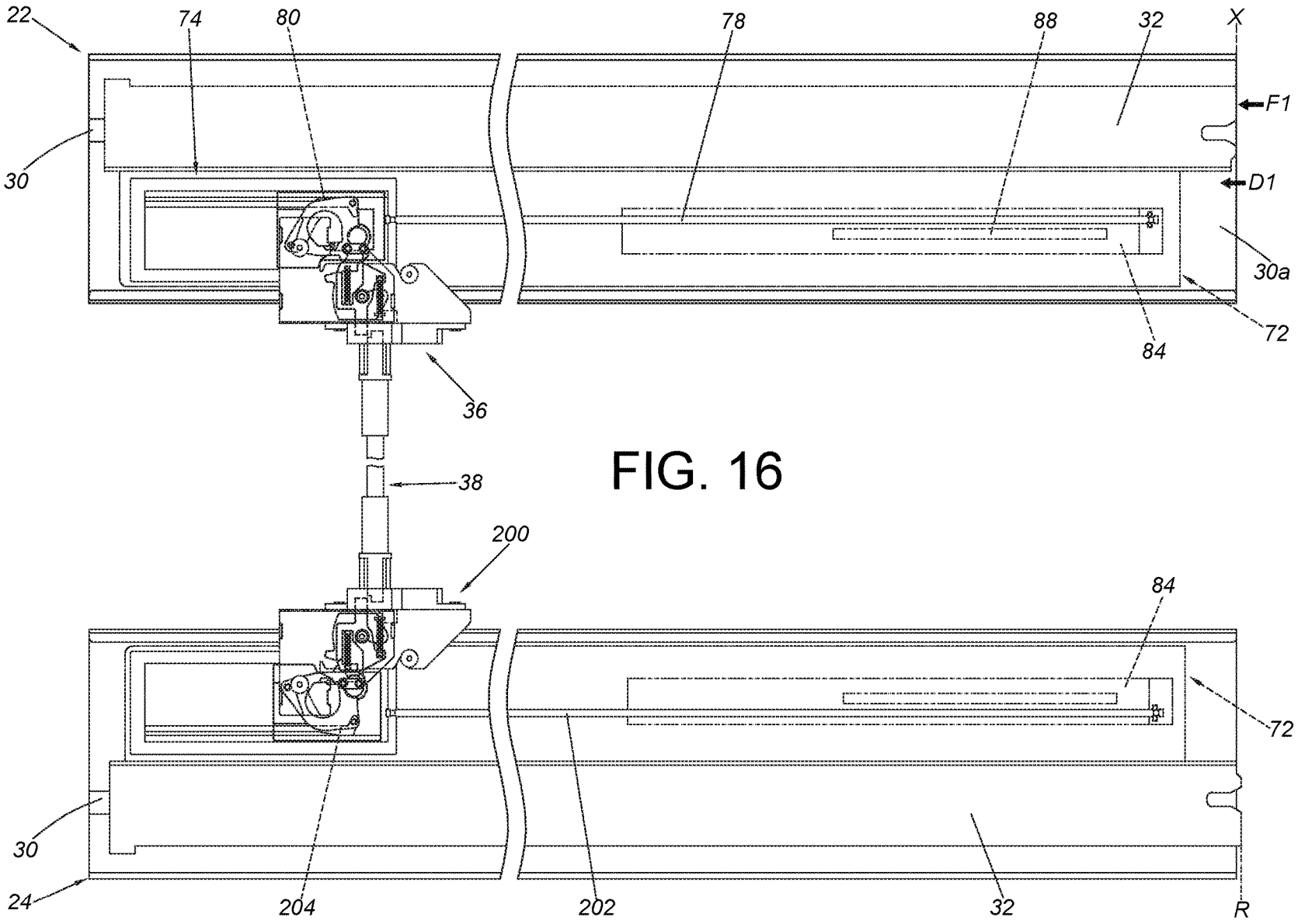
FIG. 16 is a diagram showing the second rail of the first slide rail assembly being located at an over-pressing position relative to a first rail of the first slide rail assembly according to an embodiment of the present invention.

As shown in FIG. 16, the movable member 84 can be temporarily engaged with an engaging feature of an extension base 30*a* of the first rail 30 relative to the carrying member 72. Such configuration is well known to those skilled in the art, therefore, for simplification, no further illustration is provided. In addition, the protrusion 86 is not shown in FIG. 16.

Figure 17:
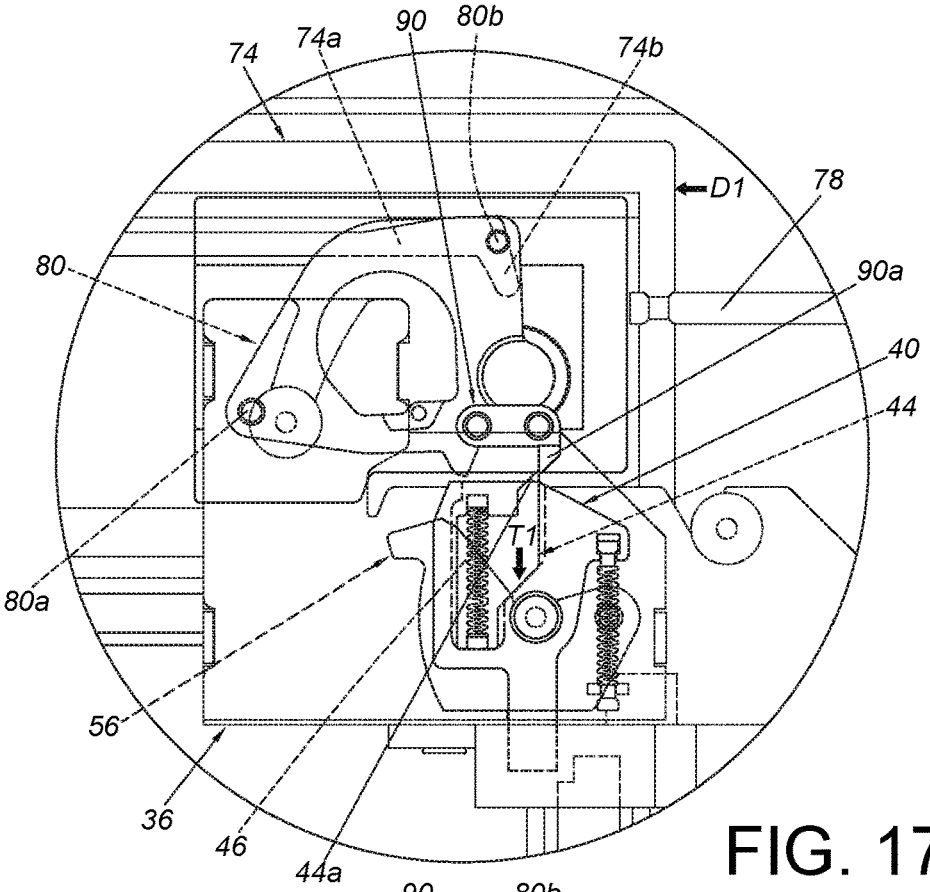
FIG. 17 is a partial enlarged view showing the second rail of the first slide rail assembly being moved relative to the first rail toward the over-pressing position along a first direction with the related parts of the synchronization device being in an operation state according to an embodiment of the present invention.
Figure 18:
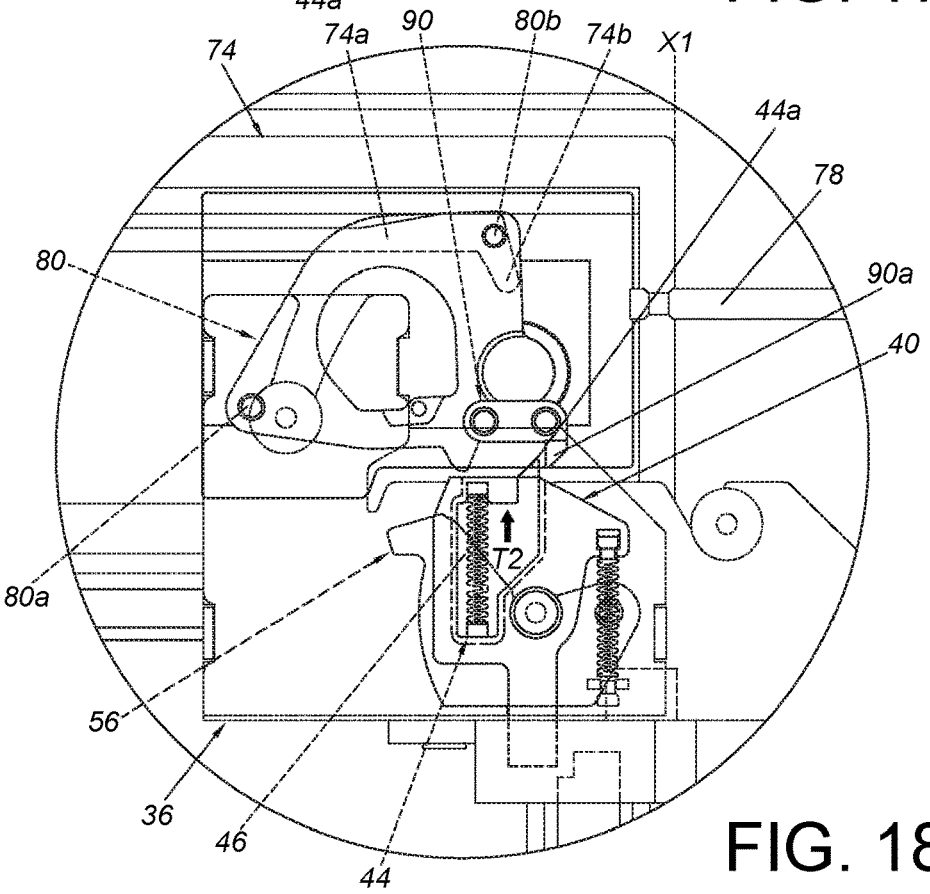
FIG. 18 is a partial enlarged view showing the second rail of the first slide rail assembly being located at the over-pressing position relative to the first rail with the related parts of the synchronization device being in another operation state according to an embodiment of the present invention.

As shown in FIG. 16, FIG. 17 and FIG. 18, when a user applies a pressing force F1 along a first direction D1 to the second rail 32 of the first slide rail assembly 22, to move the second rail 32 of the first slide rail assembly 22 relative to the first rail 30 of the first slide rail assembly 22 from the retracted position R to an over-pressing position X along the first direction D1 (such as a closing direction), the connecting base 74 is moved along the first direction D1 accordingly. Therefore, the locking member 80 of the first opening mechanism is configured to be driven to move by the connecting base 74 through the second leg 80*b*, such that the locking member 80 is rotated through the first leg 80*a* to disengage the second leg 80*b* from the engaging part 74*b* of the connecting base 74, and the second leg 80*b* further enters the disengaging part 74*a* of the connecting base 74. As such, the locking member 80 of the first opening mechanism unlocks the elastic member 78 of the first opening mechanism. On the other hand, during a process of the second rail 32 of the first slide rail assembly 22 being moved relative to the first rail 30 of the first slide rail assembly 22 from the retracted position R to the over-pressing position X along the first direction D1, the second contact part 44*a* of the actuating member 44 contacts the first contact part 90*a* of the auxiliary member 90 to generate a working force, such that the actuating member 44 is moved relative to the driving member 40 from the first predetermined position to a second predetermined position along a first transverse direction T1 in response to the working force, and the second contact part 44*a* of the actuating member 44 and the first contact part 90*a* of the auxiliary member 90 are interlaced. In the meantime, the first elastic member 46 accumulates an elastic force (as shown in FIG. 17). When the second rail 32 of the first slide rail assembly 22 is located at the over-pressing position X relative to the first rail 30 of the first slide rail assembly 22 (in FIG. 18, the connecting base 74 is located at one position X1 correspondingly), the second contact part 44*a* of the actuating member 44 completely crosses the first contact part 90*a* of the auxiliary member 90 to be located at the other side of the first contact part 90*a* of the auxiliary member 90 (as shown in FIG. 18). In addition, the first elastic member 46 is configured to release the elastic force, such that the actuating member 44 is moved from the second predetermined position back to the first predetermined position (as shown in FIG. 18) along a second transverse direction T2 (a direction opposite to the first transverse direction T1) in response to the elastic force of the first elastic member 46. In the meantime, the second contact part 44*a* of the actuating member 44 is located at a position corresponding to the other side of the first contact part 90*a* of the auxiliary member 90. Moreover, when the second rail 32 of the first slide rail assembly 22 is located at the over-pressing position X relative to the first rail 30 of the first slide rail assembly 22, the related parts of the second synchronization device 200 are still in the initial state.

Figure 19:
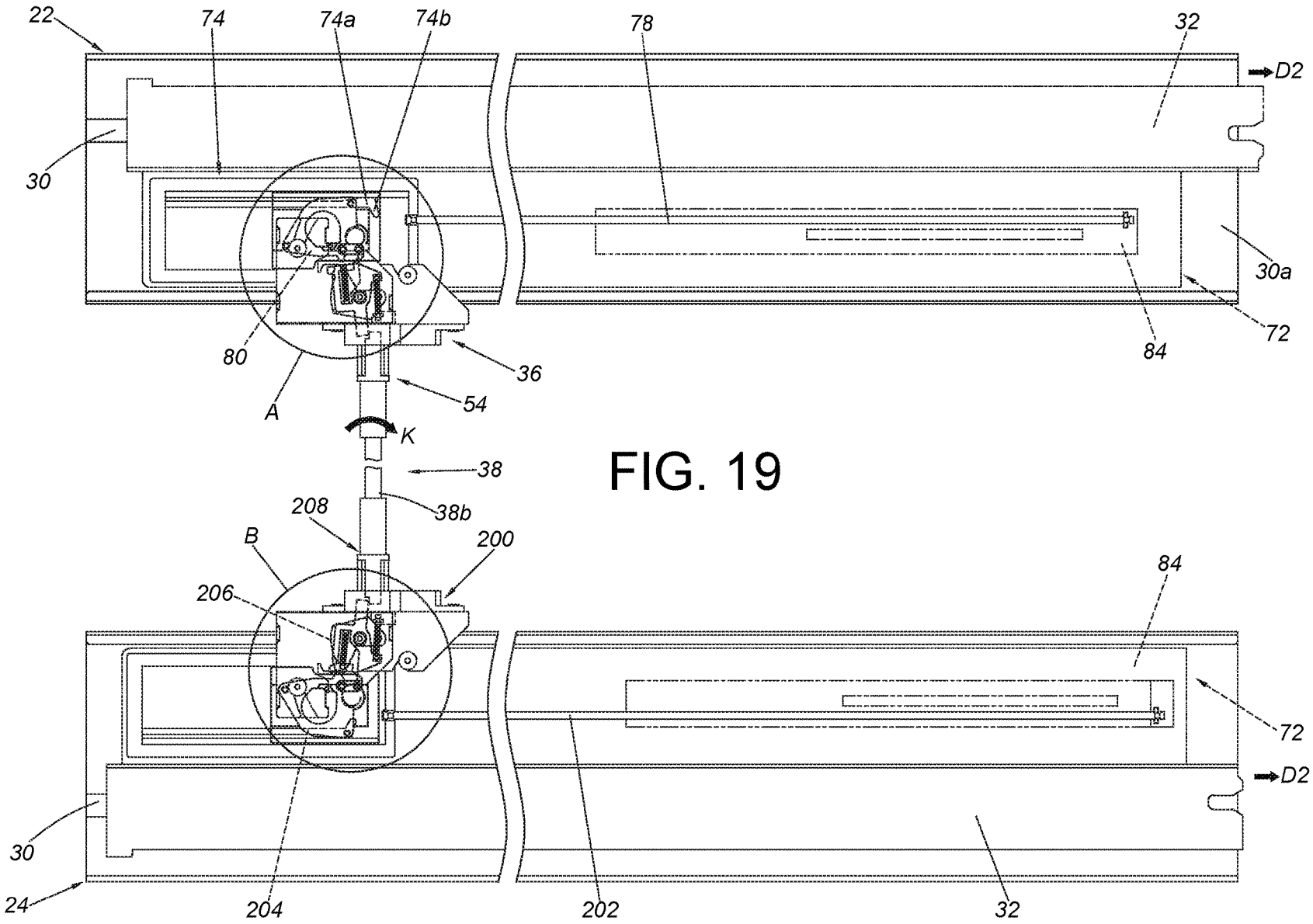
FIG. 19 is a diagram showing the second rails of the first slide rail assembly and the second slide rail assembly being moved relative to the first rails along a second direction through the synchronization system according to an embodiment of the present invention.

As shown in FIG. 19, when the user stops applying the pressing force F1 along the first direction D1 to the second rail 32 of the first slide rail assembly 22, the elastic member 78 of the first opening mechanism immediately releases a first elastic force along a second direction D2 (a direction opposite to the first direction, such as an opening direction) in order to drive the second rail 32 of the first slide rail assembly 22 to move relative to the first rail 30 of the first slide rail assembly 22 from the over-pressing position X along the second direction D2.

Figure 20:
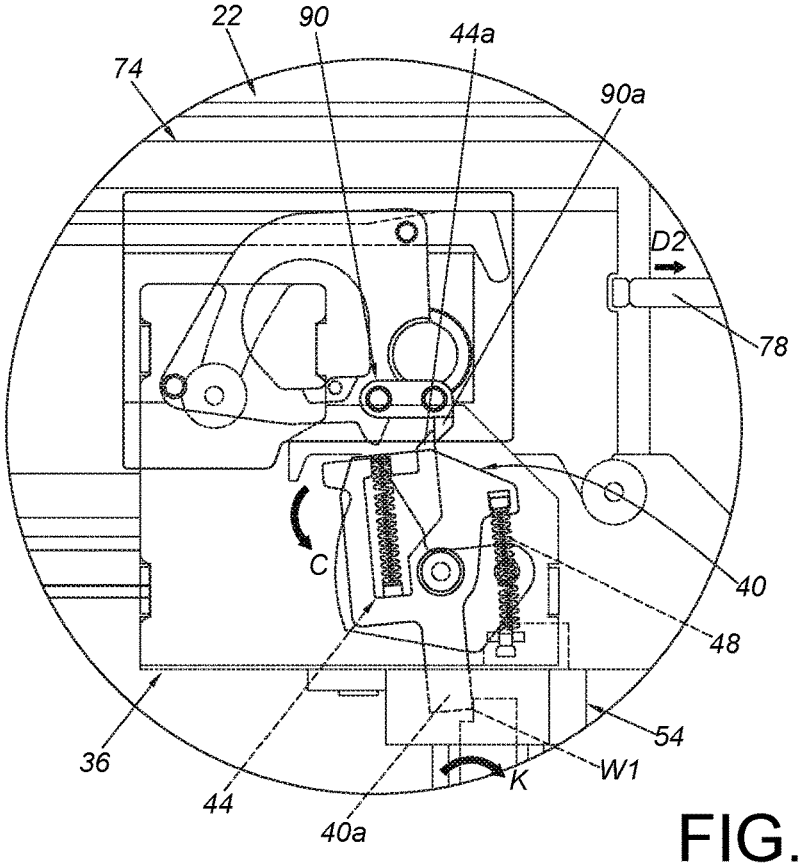
FIG. 20 is an enlarged view of an area A of FIG. 19.
Figure 21:
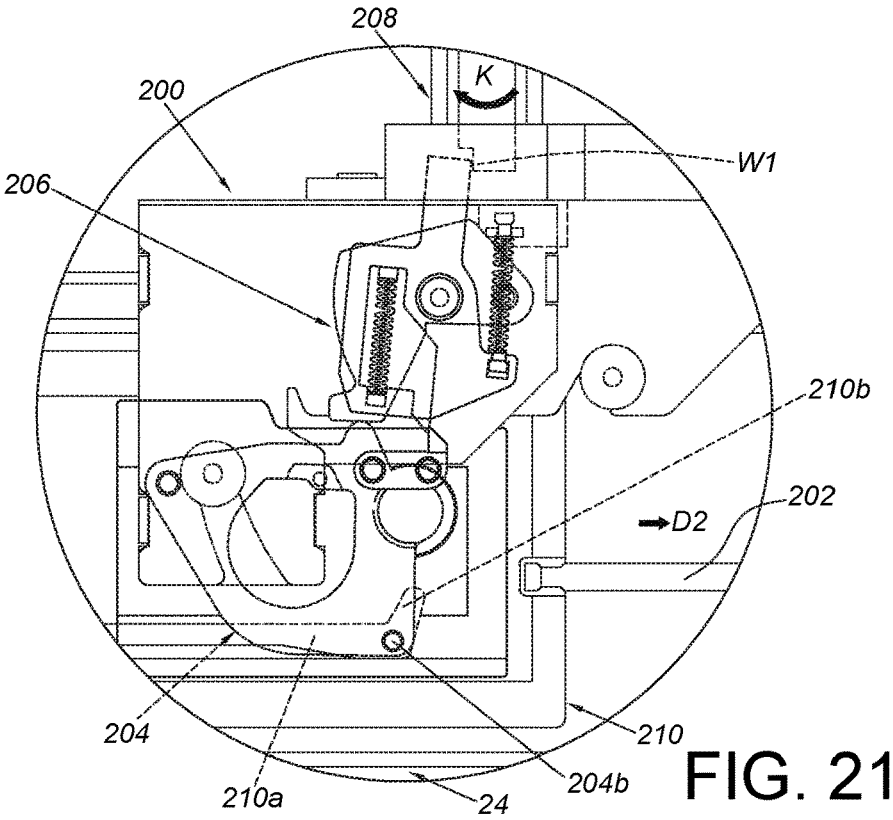
FIG. 21 is an enlarged view of an area B of FIG. 19.

As shown in FIG. 19, FIG. 20 and FIG. 21, when the second rail 32 of the first slide rail assembly 22 is moved a predetermined distance from the over-pressing position X along the second direction D2, the driving member 40 of the first synchronization device 36 is driven to move (as shown in FIG. 20) to further drive the working member 206 of the second synchronization device 200 to move through the synchronization rod 38, such that the locking member 204 of the second opening mechanism unlocks the elastic member 202 of the second opening mechanism (as shown in FIG. 21) to allow the elastic member 202 of the second opening mechanism to release a second elastic force for driving the second rail 32 of the second slide rail assembly 24 to move relative to the first rail 30 of the second slide rail assembly 24 along the second direction D2.

Specifically, when the second rail 32 of the first slide rail assembly 22 is moved the predetermined distance from the over-pressing position X along the second direction D2, the second contact part 44*a* of the actuating member 44 at the first predetermined position is configured to push the first contact part 90*a* of the auxiliary member 90 to generate a force (such as the force F shown in FIG. 8), such that the driving member 40 of the first synchronization device 36 is driven to rotate from the initial state along the rotary direction C (as shown in FIG. 20) to further drive the sleeve 54 of the first synchronization device 36 and the synchronization rod 38 to correspondingly rotate along the predetermined rotation direction K. As such, the second end part 38*b* of the synchronization rod 38 is configured to further drive the working member 206 of the second synchronization device 200 to rotate through the first section W1 of the sleeve 208 of the second synchronization device 200, such that the locking member 204 of the second opening mechanism is driven to move the second leg 204*b* of the locking member 204 away from the engaging part 210*b* of the connecting base 210 of the second slide rail assembly 24, and the second leg 204*b* further enters the disengaging part 210*a* of the connecting base 210 to allow the locking member 204 of the second opening mechanism to unlock the elastic member 202 of the second opening mechanism, in order to allow the elastic member 202 of the second opening mechanism to release the second elastic force for driving the second rail 32 of the second slide rail assembly 24 to move with the second rail 32 of the first slide rail assembly 22 along the second direction D2.

Moreover, the present invention further provides a driving method for the slide rail assemblies 22, 24. The driving method is disclosed in the aforementioned embodiments. For simplification, no further illustration is provided.

Therefore, the synchronization system, the synchronization device and the driving method for the slide rail assembly according to the embodiments of the present invention are characterized in that:

1. Different from the prior art, the second rail 32 of the second slide rail assembly 24 of the embodiment of the present invention is not configured to be opened earlier than the second rail 32 of the first slide rail assembly 22 when the user applies the pressing force F1 to the second rail 32 of the first slide rail assembly 22 to drive the second rail 32 of the first slide rail assembly 22 to move from the retracted position R to the over-pressing position X. Furthermore, when the user stops applying the pressing force F1, the second rail 32 of the first slide rail assembly 22 at the over-pressing position X is opened to move the predetermined distance along the second direction D2 in response to the first elastic force of the elastic member 78 of the first opening mechanism, such that the synchronization rod 38 is driven by the driving member 40 of the first synchronization device 36 to further drive the related parts of the second synchronization device 200 to move, so as to drive the locking member 204 of the second opening mechanism to unlock the elastic member 202 of the second opening mechanism for allowing the elastic member 202 of the second opening mechanism to release the second elastic force, in order to drive the second rail 32 of the second slide rail assembly 24 to move along the second direction D2. According to such driving method, the second rail 32 of the first slide rail assembly 22 and the second rail 32 of the second slide rail assembly 24 can be reliably synchronously opened along the second direction D2, so as to prevent the movable rail of the second slide rail assembly of the prior art from being opened in advance along an opening direction relative to the movable rail of the first slide rail assembly which is pressed by the user. In addition, the driving method of the embodiment of the present invention can also prevent unexpected noises caused in a case that the movable rail of the first slide rail assembly is pressed by the user with the elastic member of the second slide rail assembly being accordingly driven to release the elastic force for driving the movable rail of the second slide rail assembly to move.

2. The synchronization devices 36, 200 can be designed as detachable components, such that the user can additionally install the synchronization devices 36, 200 according to requirements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A synchronization system applicable to a furniture system, the synchronization system comprising:

a first slide rail assembly and a second slide rail assembly, each of the first slide rail assembly and the second slide rail assembly comprising a first rail and a second rail longitudinally movable relative to the first rail, the first slide rail assembly and the second slide rail assembly further comprising a first opening mechanism and a second opening mechanism respectively, wherein each of the first opening mechanisms and the second opening mechanisms comprises an elastic member and a locking member configured to lock the elastic member;

a first synchronization device arranged on the second rail of the first slide rail assembly, the first synchronization device comprising a driving member;

a second synchronization device arranged on the second rail of the second slide rail assembly, the second synchronization device comprising a working member; and a synchronization rod movably arranged between the first synchronization device and the second synchronization device;

wherein when the second rail of the first slide rail assembly is moved relative to the first rail of the first slide rail assembly from a retracted position to an over-pressing position along a first direction, the locking member of the first opening mechanism is configured to unlock the elastic member to allow the elastic member of the first opening mechanism to release a first elastic force for driving the second rail of the first slide rail assembly to move relative to the first rail of the first slide rail assembly from the over-pressing position along a second direction;

wherein when the second rail of the first slide rail assembly is moved a predetermined distance from the over-pressing position along the second direction, the driving member of the first synchronization device is driven to move to further drive the synchronization rod to rotate to further move the working member of the second synchronization device, such that the locking member of the second opening mechanism is configured to unlock the elastic member of the second opening mechanism to allow the elastic member of the second opening mechanism to release a second elastic force for driving the second rail of the second slide rail assembly to move along the second direction;

wherein the second direction is opposite to the first direction;

wherein the first slide rail assembly further comprises a carrying member and a connecting base, the carrying member is fixedly attached to the second rail of the first slide rail assembly; wherein the connecting base is fixed to the carrying member, the connecting base comprises a disengaging part and an engaging part, the disengaging part is longitudinally arranged, and the engaging part is bent relative to the disengaging part; wherein the locking member of the first opening mechanism is configured to lock the elastic member of the first opening mechanism through the engaging part of the connecting base, and the locking member of the first opening mechanism is configured to unlock the elastic member of the first opening mechanism through the disengaging part of the connecting base;

wherein the connecting base is formed with a space, the first slide rail assembly further comprises a slide rail part accommodated in the space of the connecting base, the slide rail part and the connecting base are configured to be longitudinally movable relative to each other, the slide rail part is arranged with an auxiliary member, and the auxiliary member comprises a first contact part; wherein the first synchronization device further comprises a base, an actuating member and a first elastic member, the base is mounted to the second rail of the first slide rail assembly, the driving member is movably mounted to the base, the actuating member is movable relative to the driving member, the actuating member comprises a second contact part, and the first elastic member is configured to elastically press the actuating member; wherein during a process of the second rail of the first slide rail assembly being moved from the retracted position to the over-pressing position along the first direction, the second contact part of the actuating member is configured to contact the first contact part of the auxiliary member to generate a working force, such that the actuating member is transversely moved relative to the driving member from a first predetermined position to a second predetermined position in response to the working force to allow the first elastic member to accumulate an elastic force; wherein when the second rail of the first slide rail assembly is moved to the over-pressing position, the second contact part of the actuating member is configured to cross the first contact part of the auxiliary member, and the actuating member is configured to return to the first predetermined position in response to the elastic force released by the first elastic member; wherein when the second rail of the first slide rail assembly is moved the predetermined distance from the over-pressing position along the second direction, the actuating member at the first predetermined position is configured to contact the auxiliary member to drive the driving member of the first synchronization device to move from an initial state to further drive the synchronization rod to rotate.

2. The synchronization system of claim 1, wherein the first synchronization device and the second synchronization device are respectively detachably mounted to the second rail of the first slide rail assembly and the second rail of the second slide rail assembly.

3. The synchronization system of claim 2, wherein the synchronization rod is detachably mounted between the first synchronization device and the second synchronization device.

4. The synchronization system of claim 1, wherein one of the first contact part of the auxiliary member and the second contact part of the actuating member has an inclined surface or an arc surface.

5. The synchronization system of claim 1, wherein the driving member of the first synchronization device is pivoted relative to the base, and the first synchronization device further comprises a second elastic member; wherein the driving member of the first synchronization device is configured to return to the initial state in response to an elastic force of the second elastic member.

6. The synchronization system of claim 5, wherein the first synchronization device further comprises a housing, the housing is configured to cover a portion of the driving member, and the housing has a blocking feature configured to prevent the driving member from rotating along a predetermined direction.

7. The synchronization system of claim 5, wherein the base comprises a first part and a second part bent relative to the first part, the driving member of the first synchronization device is pivoted to the first part of the base, and the driving member has an accommodating room configured to accommodate at least one portion of the actuating member; wherein the first synchronization device further comprises a mounting base and a sleeve, the mounting base is arranged on the second part of the base, and an end part of the synchronization rod is rotatably mounted to the mounting base through the sleeve.

8. The synchronization system of claim 7, wherein the second part of the base is substantially perpendicularly bent relative to the first part of the base.

9. The synchronization system of claim 7, wherein structural configuration of the second synchronization device is substantially identical to or symmetric to structural configuration of the first synchronization device, and structural configuration of the second slide rail assembly is substantially identical to or symmetric to structural configuration of the first slide rail assembly.

10. The synchronization system of claim 1, wherein the first rail is fixedly mounted to a first furniture part of the furniture system, and the second rail is configured to carry a second furniture part of the furniture system.

11. A slide rail assembly comprising:

a first rail;

a second rail longitudinally movable relative to the first rail;

an opening mechanism comprising an elastic member and a locking member configured to temporarily lock the elastic member; and a synchronization device comprising:

a base connected to the second rail of the slide rail assembly, the base comprising a first part and a second part;

a driving member movably mounted to the first part of the base;

a mounting base arranged on the second part of the base;

a sleeve rotatably mounted to the mounting base; and a synchronization rod connected to the sleeve;

wherein when the second rail is moved relative to the first rail from a retracted position to an over-pressing position along a first direction, the locking member is configured to unlock the elastic member to allow the elastic member to release an elastic force for driving the second rail to move along a second direction;

wherein when the second rail is moved a predetermined distance along the second direction, the driving member is driven to move to further drive the sleeve to rotate for driving the synchronization rod to rotate accordingly;

wherein the slide rail assembly further comprises a carrying member and a connecting base, wherein the carrying member is fixedly attached to the second rail; the connecting base is fixed to the carrying member, the connecting base comprises a disengaging part and an engaging part, the disengaging part is longitudinally arranged, and the engaging part is bent relative to the disengaging part; the locking member is configured to lock the elastic member through the engaging part of the connecting base, and the locking member is configured to unlock the elastic member through the disengaging part of the connecting base;

wherein the connecting base is formed with a space, the slide rail assembly further comprises a slide rail part accommodated in the space of the connecting base, the slide rail part and the connecting base are configured to be longitudinally movable relative to each other, the slide rail part is arranged with an auxiliary member, and the auxiliary member comprises a first contact part; wherein the synchronization device further comprises an actuating member and a first elastic member, the actuating member is movable relative to the driving member, the actuating member comprises a second contact part, and the first elastic member is configured to elastically press the actuating member; wherein during a process of the second rail being moved from the retracted position to the over-pressing position along the first direction, the second contact part of the actuating member is configured to contact the first contact part of the auxiliary member to generate a working force, such that the actuating member is moved relative to the driving member from a first predetermined position to a second predetermined position in response to the working force to allow the first elastic member to accumulate an elastic force; wherein when the second rail is moved to the over-pressing position, the second contact part of the actuating member is configured to cross the first contact part of the auxiliary member, and the actuating member is configured to return to the first predetermined position in response to the elastic force released by the first elastic member; wherein when the second rail is moved the predetermined distance from the over-pressing position along the second direction, the actuating member at the first predetermined position is configured to contact the auxiliary member to drive the driving member to move from an initial state to further drive the synchronization rod to rotate through the sleeve.

12. The slide rail assembly of claim 11, wherein the synchronization device is detachably mounted to the second rail of the slide rail assembly.

13. The slide rail assembly of claim 11, wherein one of the first contact part of the auxiliary member and the second contact part of the actuating member has an inclined surface or an arc surface.

14. The slide rail assembly of claim 11, wherein the driving member is pivoted relative to the base, and the synchronization device further comprises a second elastic member; wherein the driving member is configured to return to the initial state in response to an elastic force of the second elastic member.

15. The slide rail assembly of claim 14, wherein the synchronization device further comprises a housing, the housing is configured to cover a portion of the driving member, and the housing has a blocking feature configured to prevent the driving member from rotating along a predetermined direction; wherein the second part of the base is substantially perpendicularly bent relative to the first part of the base, the driving member is pivoted to the first part of the base, and the driving member has an accommodating room configured to accommodate at least one portion of the actuating member.

16. A driving method for a slide rail assembly, comprising:

providing a first slide rail assembly and a second slide rail assembly, wherein each of the first slide rail assembly and the second slide rail assembly comprises a first rail and a second rail movable relative to the first rail;

providing a first opening mechanism and a second opening mechanism respectively arranged on the first slide rail assembly and the second slide rail assembly, wherein each of the first opening mechanism and the second opening mechanism comprises an elastic member and a locking member configured to temporarily lock the elastic member;

providing a first synchronization device arranged on the second rail of the first slide rail assembly, wherein the first synchronization device comprises a driving member;

providing a second synchronization device arranged on the second rail of the second slide rail assembly, wherein the second synchronization device comprises a working member;

providing a synchronization rod movably arranged between the first synchronization device and the second synchronization device;

providing a carrying member and a connecting base on the first slide rail assembly; wherein the carrying member is fixedly attached to the second rail of the first slide rail assembly; wherein the connecting base is fixed to the carrying member, the connecting base comprises a disengaging part and an engaging part, the disengaging part is longitudinally arranged, and the engaging part is bent relative to the disengaging part; wherein the locking member of the first opening mechanism is configured to lock the elastic member of the first opening mechanism through the engaging part of the connecting base, and the locking member of the first opening mechanism is configured to unlock the elastic member of the first opening mechanism through the disengaging part of the connecting base; wherein the connecting base is formed with a space;

providing a slide rail part on the first slide rail assembly; wherein the slide rail part is accommodated in the space of the connecting base, the slide rail part and the connecting base are configured to be longitudinally movable relative to each other, the slide rail part is arranged with an auxiliary member, and the auxiliary member comprises a first contact part;

providing a base, an actuating member and a first elastic member on the first synchronization device; wherein the base is mounted to the second rail of the first slide rail assembly, the driving member is movably mounted to the base, the actuating member is movable relative to the driving member, the actuating member comprises a second contact part, and the first elastic member is configured to elastically press the actuating member;

applying a force to the second rail of the first slide rail assembly to move the second rail of the first slide rail assembly from a retracted position to an over-pressing position along a first direction;

the locking member of the first opening mechanism unlocking the elastic member of the first opening mechanism in response to the second rail of the first slide rail assembly being located at the over-pressing position, to allow the elastic member of the first opening mechanism to release a first elastic force for driving the second rail of the first slide rail assembly to move along a second direction opposite to the first direction; and the driving member of the first synchronization device driving the synchronization rod to rotate to further move the working member of the second synchronization device when the second rail of the first slide rail assembly is moved a predetermined distance along the second direction, so as to drive the locking member of the second opening mechanism to unlock the elastic member of the second opening mechanism to allow the elastic member of the second opening mechanism to release a second elastic force for driving the second rail of the second slide rail assembly to move along the second direction;

wherein during a process of the second rail of the first slide rail assembly being moved from the retracted position to the over-pressing position along the first direction, the second contact part of the actuating member is configured to contact the first contact part of the auxiliary member to generate a working force, such that the actuating member is transversely moved relative to the driving member from a first predetermined position to a second predetermined position in response to the working force to allow the first elastic member to accumulate an elastic force; wherein when the second rail of the first slide rail assembly is moved to the over-pressing position, the second contact part of the actuating member is configured to cross the first contact part of the auxiliary member, and the actuating member is configured to return to the first predetermined position in response to the elastic force released by the first elastic member; wherein when the second rail of the first slide rail assembly is moved the predetermined distance from the over-pressing position along the second direction, the actuating member at the first predetermined position is configured to contact the auxiliary member to drive the driving member of the first synchronization device to move from an initial state to further drive the synchronization rod to rotate.

* * * * *